US011584124B2

(12) United States Patent
Yamaguchi

(10) Patent No.: US 11,584,124 B2
(45) Date of Patent: Feb. 21, 2023

(54) LIQUID EJECTING APPARATUS, EMBROIDERY SYSTEM, AND METHOD FOR CONTROLLING LIQUID EJECTING APPARATUS

(71) Applicant: Kohhei Yamaguchi, Kanagawa (JP)

(72) Inventor: Kohhei Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

(21) Appl. No.: 17/132,136

(22) Filed: Dec. 23, 2020

(65) Prior Publication Data

US 2021/0197557 A1 Jul. 1, 2021

(30) Foreign Application Priority Data

Dec. 25, 2019 (JP) ..... JP2019-235065
Dec. 18, 2020 (JP) ..... JP2020-210141

(51) Int. Cl.

| | |
|---|---|
| ***B41J 2/045*** | (2006.01) |
| ***B41J 3/407*** | (2006.01) |
| ***B41J 11/00*** | (2006.01) |
| ***B41J 2/145*** | (2006.01) |

(52) U.S. Cl.
CPC ..... *B41J 2/04573* (2013.01); *B41J 2/145* (2013.01); *B41J 3/4078* (2013.01); *B41J 11/008* (2013.01)

(58) Field of Classification Search
CPC ..... B41J 2002/16573; B41J 2/16585
See application file for complete search history.

(56) References Cited

U.S. PATENT DOCUMENTS 6,189,989 B1 * 2/2001 Hirabayashi ..... D06P 5/30 427/288
6,783,209 B2 * 8/2004 Gompertz ..... B41J 2/165 347/29
2003/0038856 A1 * 2/2003 Vega ..... B41J 2/16508 347/23
2009/0241819 A1 * 10/2009 Tseng ..... B41J 3/4078 112/470.05

(Continued)

FOREIGN PATENT DOCUMENTS

| | | |
|---|---|---|
| JP | H06-305129 | 11/1994 |
| JP | 2010-094950 | 4/2010 |
| JP | 2017-094546 | 6/2017 |

*Primary Examiner* — Shelby L Fidler
(74) *Attorney, Agent, or Firm* — IPUSA, PLLC

(57) ABSTRACT

A liquid ejecting apparatus includes a plurality of ejection heads, each including a nozzle array in which a plurality of nozzles, each configured to eject a droplet, are arranged in an array; and an ejection receiver configured to receive the droplet from the plurality of ejection heads. A conveying direction in which an ejection target medium is conveyed and an arrangement direction in which the nozzle array is arranged are parallel to each other, and at a predetermined timing, at least one ejection head among the plurality of ejection heads moves to a position facing the ejection target medium and ejects the droplet toward the ejection target medium, and, simultaneously, a remaining ejection head among the plurality of ejection heads other than the at least one ejection head moves to be withdrawn from the position facing the ejection target medium and ejects the droplet toward the ejection receiver.

12 Claims, 21 Drawing Sheets

(56) References Cited

U.S. PATENT DOCUMENTS

| | | | | |
|---|---|---|---|---|
| 2011/0109692 | A1* | 5/2011 | Ito | B41J 2/1714 347/34 |
| 2011/0254896 | A1* | 10/2011 | Ferrarotti | B41J 3/4078 29/890.1 |
| 2012/0320118 | A1* | 12/2012 | Yokomaku | B41J 2/16526 347/11 |
| 2020/0139727 | A1* | 5/2020 | Jackson | B41J 3/4078 |
| 2020/0171842 | A1* | 6/2020 | Ishihara | F21V 7/0058 |
| 2020/0207117 | A1 | 7/2020 | Ikegami | |

* cited by examiner

LIQUID EJECTING APPARATUS, EMBROIDERY SYSTEM, AND METHOD FOR CONTROLLING LIQUID EJECTING APPARATUS

CROSS-REFERENCE TO RELATED APPLICATION

The present application is based on and claims priority under 35 U.S.C. § 119 to Japanese Patent Application No. 2019-235065, filed on Dec. 25, 2019, and Japanese Patent Application No. 2020-210141, filed on Dec. 18, 2020, the contents of which are incorporated herein by reference in their entirety.

BACKGROUND OF THE INVENTION

1. Field of the Invention

The present invention relates to a liquid ejecting apparatus for ejecting liquid onto a linear ejection target medium such as thread, an embroidery system, and a method for controlling the liquid ejecting apparatus.

2. Description of the Related Art

In a thread coloring apparatus for coloring a thread to be scanned in parallel with a nozzle array of an inkjet head, there is a technology for withdrawing the nozzle array from the thread in a state where the thread conveyance is stopped for performing a maintenance operation during an ejection operation, performing idle ejection, returning the nozzle array to the ejection position, and resuming the ejection operation.

For example, Patent Document 1 discloses an embroidery machine having a print function in which a color for dyeing a print medium is determined from design data, and the print medium is used to embroider with multiple colors, in which the nozzles undergo a maintenance/recovery operation upon withdrawing the thread from the nozzle array.

Patent Document 1: Japanese Unexamined Patent Application Publication No. H06-305129

SUMMARY OF THE INVENTION

According to one aspect of the present invention, there is provided a liquid ejecting apparatus including a plurality of ejection heads, each including a nozzle array in which a plurality of nozzles, each configured to eject a droplet, are arranged in an array; and an ejection receiver configured to receive the droplet from the plurality of ejection heads, wherein a conveying direction in which an ejection target medium is conveyed and an arrangement direction in which the nozzle array is arranged are parallel to each other, and at a predetermined timing, at least one ejection head among the plurality of ejection heads moves to a position facing the ejection target medium and ejects the droplet toward the ejection target medium, and, simultaneously, a remaining ejection head among the plurality of ejection heads other than the at least one ejection head moves to be withdrawn from the position facing the ejection target medium and ejects the droplet toward the ejection receiver.

DETAILED DESCRIPTION OF THE PREFERRED EMBODIMENTS

Figure 1:
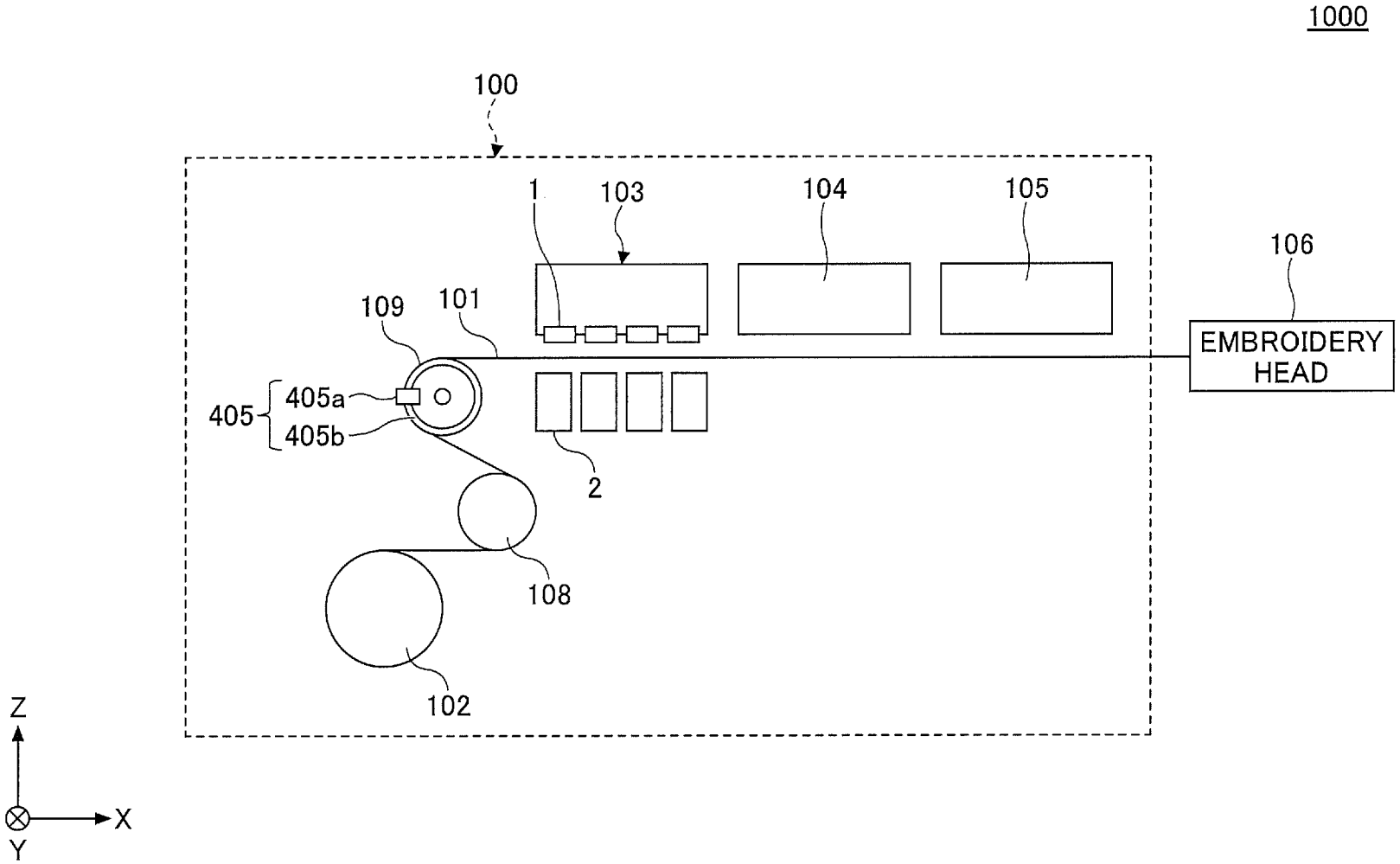
FIG. 1 illustrates example of a coloring/embroidery system including a liquid ejecting apparatus according to a first embodiment of the present invention.

In the above-described technique of Patent Document 1, it is necessary to perform capping, and then perform the recovery operation, and, therefore, there has been a problem in that the productivity decreases.

A problem to be addressed by an embodiment of the present invention is to provide a liquid ejecting apparatus for ejecting liquid to an ejection target medium, that enables idle ejection, which is a maintenance/recovery operation, without stopping the conveyance during the ejection operation, thereby improving productivity.

Hereinafter, an embodiment for carrying out the present invention will be described with reference to the drawings. In the following drawings, the same elements are denoted by the same reference numerals, and overlapping descriptions may be omitted.

First Embodiment

<Overall Configuration>

Figure 2:
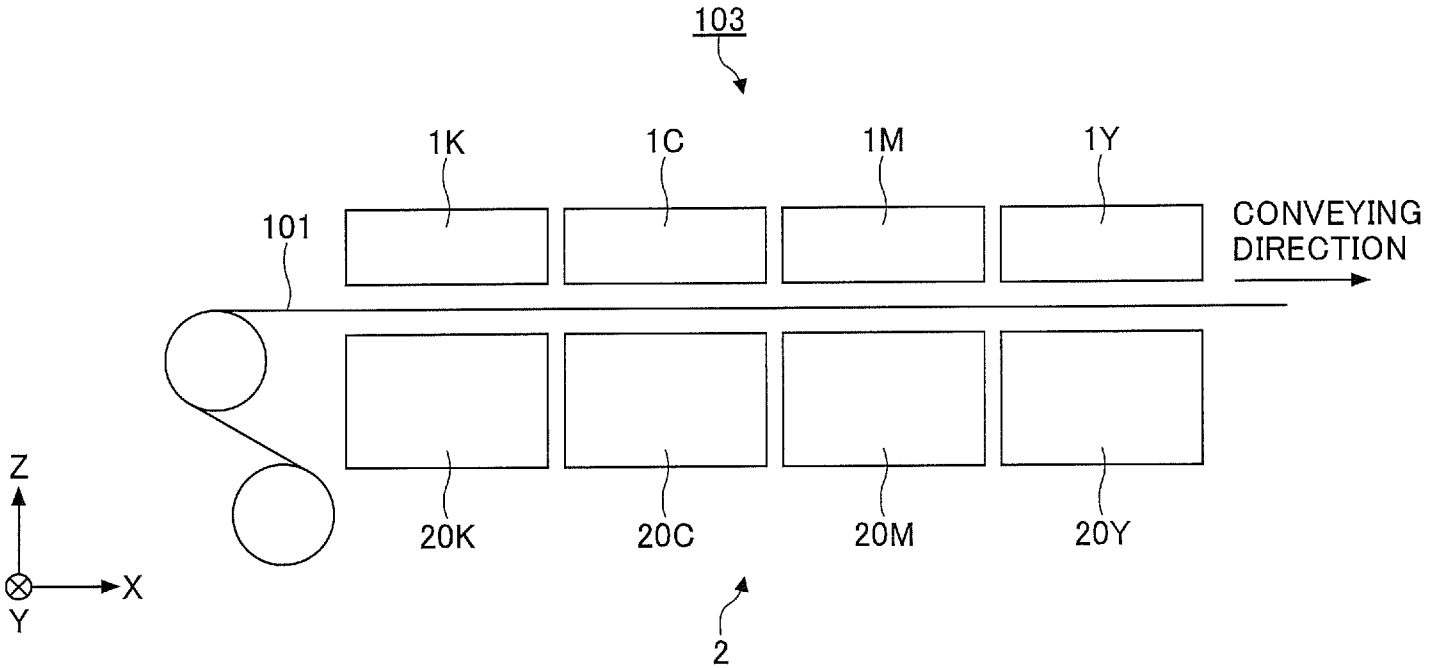
FIG. 2 is a schematic side view of a liquid applying unit and a maintenance unit of the liquid ejecting apparatus according to the first embodiment of the present invention.
Figure 3:
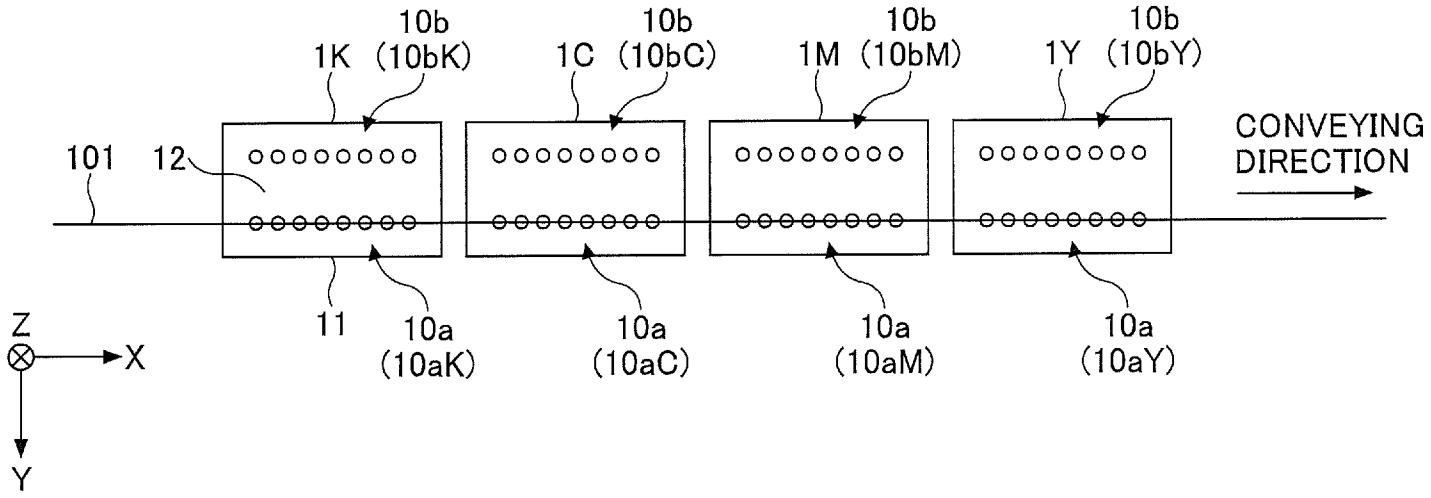
FIG. 3 is a schematic bottom view of a liquid applying unit of the liquid ejecting apparatus according to the first embodiment of the present invention.

First, a coloring/embroidery apparatus including a liquid ejecting apparatus according to an embodiment of the present invention will be described with reference to FIGS. 1 to 3. FIG. 1 is a schematic diagram illustrating an example of a coloring/embroidery apparatus according to an embodiment of the present invention. FIG. 2 is a side schematic diagram illustrating a portion around a liquid applying unit in the liquid ejecting apparatus according to a first embodiment of the present invention. FIG. 3 is a bottom view of the liquid applying unit of the liquid ejecting apparatus according to the first embodiment of the present invention.

A coloring/embroidery apparatus 1000 (coloring/embroidery system) is an in-line embroidery apparatus that includes a supply reel 102 around which a thread 101 is wound, a liquid applying unit 103, a fixing unit 104, a post-processing unit 105, and an embroidery head 106. The supply reel 102, the liquid applying unit 103, the fixing unit 104, and the post-processing unit 105, excluding the embroidery head 106, function as a liquid ejecting apparatus 100 (also referred to as a coloring apparatus portion or a dying portion) according to the present embodiment.

The thread 101 drawn from the supply reel 102 is guided by conveying rollers 108 and 109, which are the conveying mechanisms, and the thread 101 is continuously drawn to the embroidery head 106.

The conveying roller 109 is provided with a rotary encoder 405 (also referred to simply as an encoder). The rotary encoder 405 includes an encoder wheel 405*b* that rotates with the conveying roller 109 and an encoder sensor 405*a* that reads slits in the encoder wheel 405*b*.

The liquid applying unit 103 includes a plurality of heads 1 (1K to 1Y) (ejection heads) for ejecting and applying liquid of the desired color to the thread 101 drawn and conveyed from the supply reel 102, and a maintenance operation unit 2 that includes a plurality of individual maintenance units 20 (20K to 20Y) for performing maintenance of each head 1.

Hereinafter, the thread conveying direction from the liquid applying unit 103 to the embroidery head 106 is referred to as X, the depth direction (head moving direction) of the coloring/embroidery apparatus 1000 is referred to as Y, and the height direction (vertical direction) is referred to as Z.

Referring to FIG. 2, in the liquid applying unit 103, the plurality of heads 1K to 1Y are ejection heads that eject ink of different colors from each other. For example, the head 1Y is the head that ejects droplets (liquid droplets) of black (K) ink, the head 1C is the head that ejects droplets of cyan (C) ink, the head 1M is the head that ejects droplets of magenta (M) ink, and the head 1Y is the head that ejects droplets of yellow (Y) ink. The order of colors is an example and the heads may be arranged in a different order from this description.

Further, the individual maintenance units 20K, 20C, 20M, and 20Y are disposed below the liquid applying unit 103 so as to face the corresponding heads 1K, 1C, 1M, and 1Y, respectively.

Here, as illustrated in FIG. 3, the head 1K has a nozzle surface 12 on which nozzle arrays 10*a* and 10*b*, each including a plurality of nozzles 11 for ejecting droplets, are formed. Each of the heads 1K to 1Y is arranged so that the direction of the nozzle array (the arrangement of the nozzles 11) is parallel to the conveying direction of the thread 101 (thread feeding direction).

In the head 1K, drops of ink ejected by the nozzles 11 of one array (the nozzle array 10*a* in FIG. 3) located directly above the thread 101, land on the thread to color (also referred to as dyeing or printing) the thread 101. FIG. 3 illustrates an example in which two nozzle arrays 10*a* and 10*b* are arranged on the nozzle surface 12, but the number of nozzle arrays provided in the head 1K may be one array or three arrays or more. As illustrated in FIG. 3, the other heads 10, 1M, and 1Y have the same configuration as the head 1K.

Returning to FIG. 1, the fixing unit 104 performs a fixing process (a drying process) for the thread 101 to which liquid ejected from the liquid applying unit 103 has been applied. The fixing unit 104 includes, for example, a heating means such as an infrared irradiating means and a hot air blowing means, to heat and dry the thread 101.

The post-processing unit 105 includes, for example, a cleaning means for cleaning the thread 101, a tension adjusting means for adjusting the tension of the thread 101, a feed amount detecting means for detecting the amount of movement of the thread 101, a lubricating means for applying a lubricant to the surface of the thread 101, and the like.

The embroidery head 106 embroiders a pattern, such as designs and markings, on a fabric, by stitching into a fabric using the dyed thread 101.

In the present embodiment, the coloring/embroidery apparatus 1000 is described as an example of the liquid ejecting apparatus. However, the present invention is not limited thereto. The present invention can be applied to an apparatus that uses a linear ejection target medium such as thread, for example, a loom, a sewing machine, and the like.

Further, a "thread" may include a fiberglass thread, a wool thread, a cotton thread, a synthetic thread, a metal thread, wool, cotton, polymer, or a mixed metal thread, yarn, filaments, or a linear object (a linear member, a continuous base material) to which liquid can be applied, including braids, straps, and the like.

Other than a linear object described above, examples of an ejection target medium that can be dyed by ink drops include a strip-like member (continuous substrate) to which liquid can be applied, such as a rope, a cable, a cord, etc. Each ejection target medium is a linear or strip-like medium that has a narrow width and that is continuous in the conveying direction.

In the liquid ejecting apparatus of the present invention, it is assumed, for example, that the ejection of a liquid droplet to the ejection target medium from each nozzle of each color, is completed by a single ejection operation. Therefore, an ejection target medium having a narrow width is used, so that at least one-half or more of the width of the ejection target medium is occupied by the liquid when the liquid droplet lands on the medium and bleeds into the medium, more preferably, approximately the entire width of the ejection target medium is occupied by the liquid when the liquid droplet bleeds into the medium.

Figure 4:
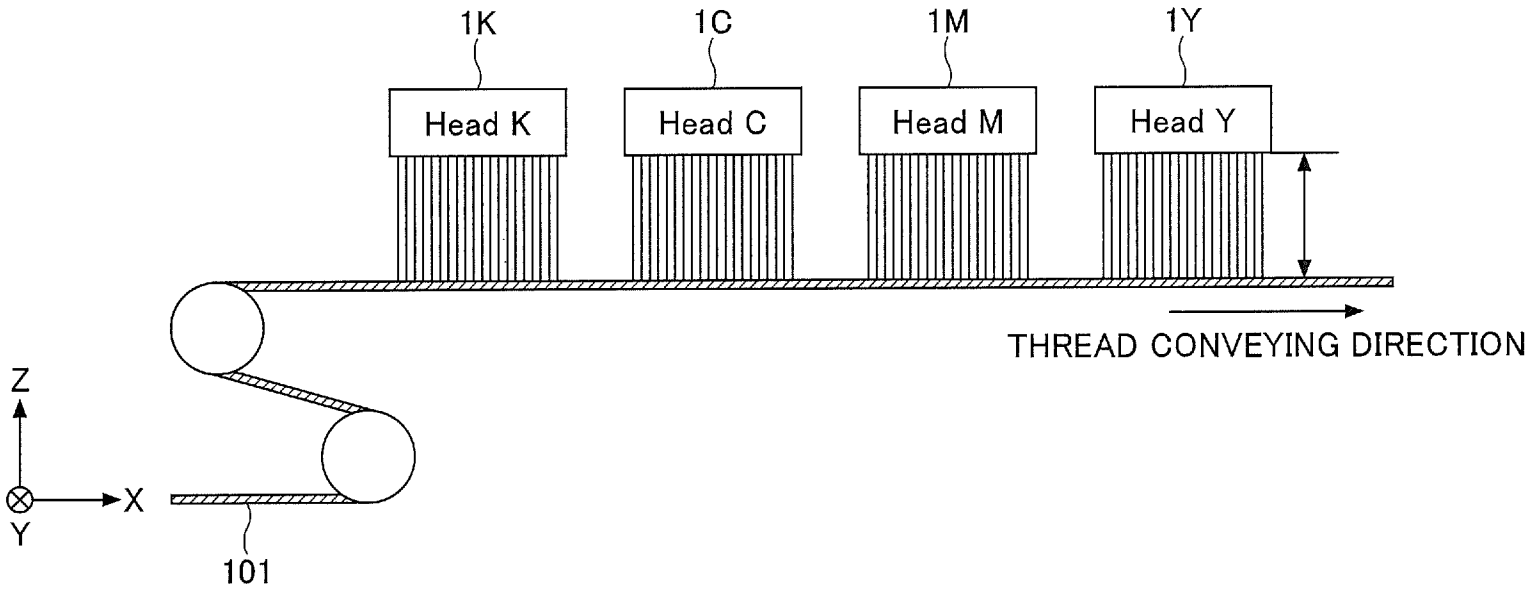
FIG. 4 is a side view illustrating a state in which droplets are ejected from a plurality of nozzles simultaneously in a plurality of heads of a liquid applying unit according to the first embodiment of the present invention.

FIG. 4 illustrates a plurality of the heads 1K to 1Y of the liquid applying unit 103, where all nozzles are simultaneously ejecting liquid on the thread 101.

As illustrated in FIG. 3, in the heads 1K to 1Y, the nozzle array 10*a* is arranged directly above the thread 101 in the conveying direction and in the same direction as the conveying direction of the thread 101. Therefore, as illustrated in FIG. 4, when droplets are ejected simultaneously from a plurality of the nozzles 11 in one of the nozzle arrays (the nozzle array 10*a* (10*a*K, 10*a*C, 10*a*M, 10*a*Y), see FIG. 3) of each of the heads 1K to 1Y with respect to the thread 101, the droplets can be ejected simultaneously at different positions in the conveying direction on the thread 101.

Movement of Position of Head According to First Embodiment

Figure 5A:
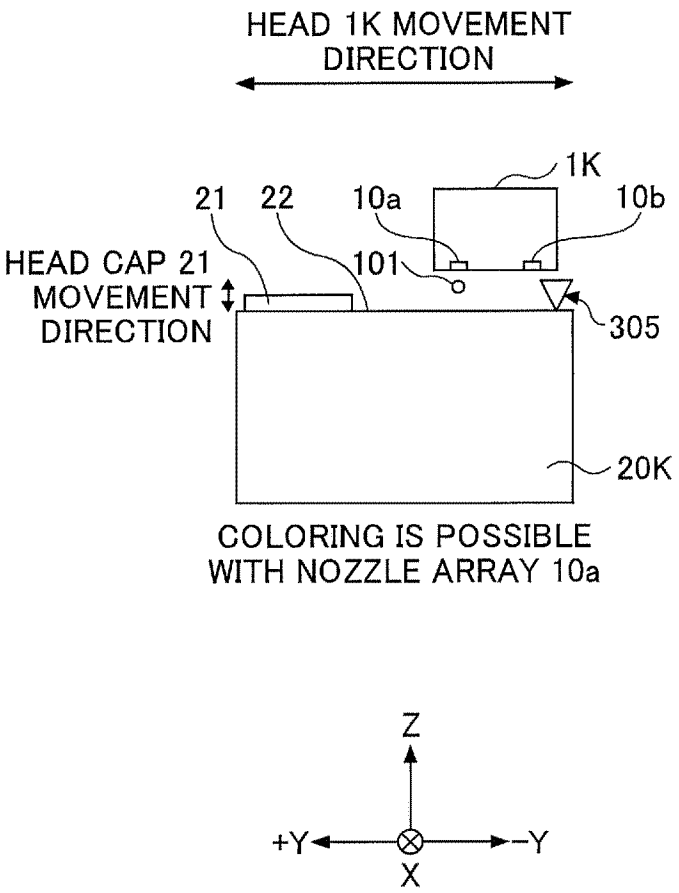
FIGS. 5A to 5C are diagrams of the liquid ejecting apparatus as viewed from a conveying direction and an orthogonal direction, explaining the movement of the head in the thread conveying direction and the orthogonal direction in the liquid applying unit in the liquid ejecting apparatus according to the first embodiment of the present invention.
Figure 5B:
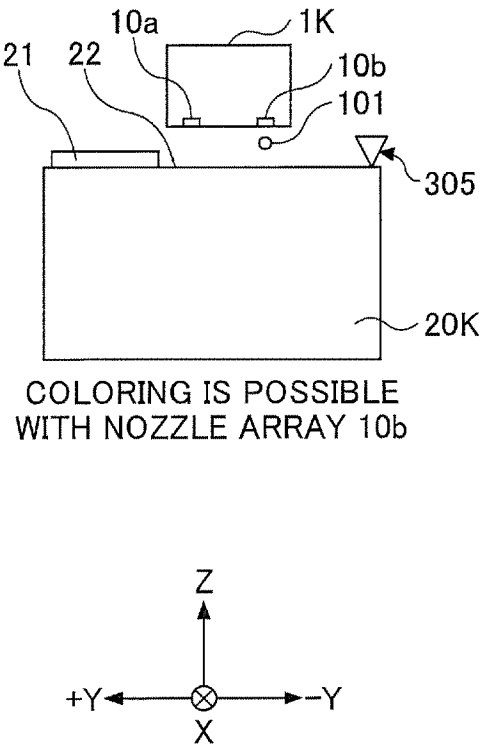
Figure 5C:
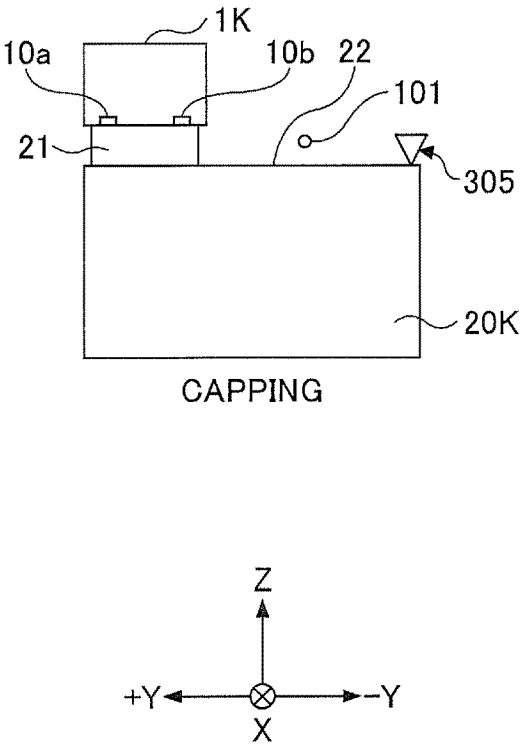
Figure 6:
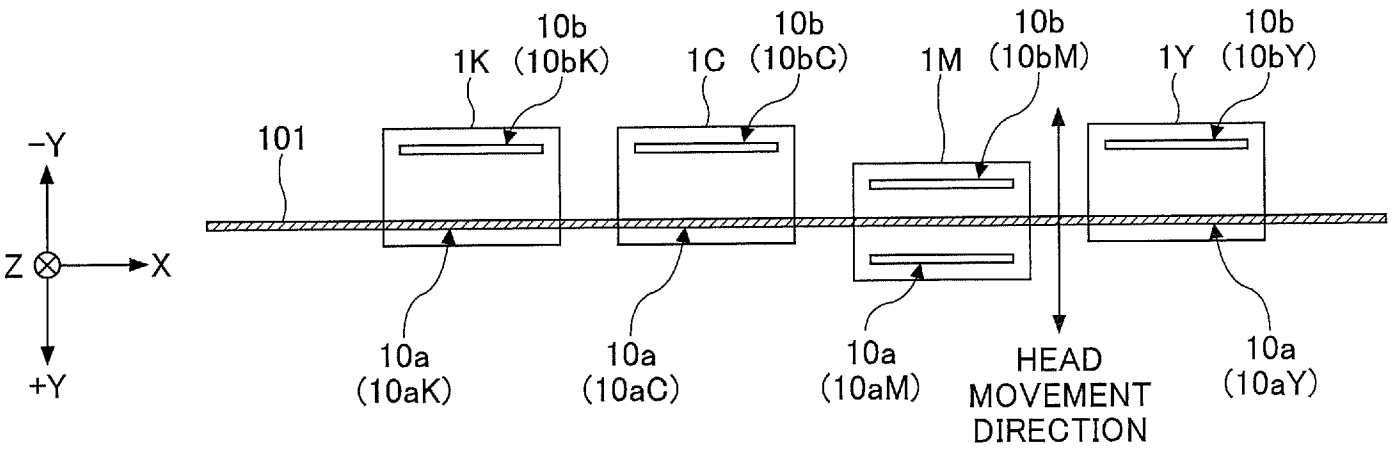
FIG. 6 is a schematic diagram illustrating the movement of the head in a thread conveying direction and an orthogonal direction in the liquid applying section of the liquid ejecting apparatus according to the first embodiment of the present invention.

Next, the movement of the head according to the first embodiment of the present invention will be described with reference to FIGS. 5A to 7. FIGS. 5A to 5C are diagrams illustrating the movement of the head in an orthogonal direction to the thread conveying direction in the liquid applying unit of the liquid ejecting apparatus according to a first embodiment of the present invention. FIG. 6 is a schematic bottom view illustrating the movement of the head in an orthogonal direction to the thread conveying direction in the liquid applying unit of the liquid ejecting apparatus according to the first embodiment of the present invention.

Specifically, FIG. 5A illustrates the position of the head 1K at which droplets can be ejected from the nozzle array 10*a* onto the thread 101, FIG. 5B illustrates the position of the head 1K at which droplets can be ejected from the nozzle array 10*b* onto the thread 101, and FIG. 5C illustrates the position of the head 1K at which the nozzle arrays 10*a* and 10*b* are capped by a cap 21.

As illustrated in FIGS. 5A to 6, the head 1K is moved perpendicular to the conveying direction of the thread 101, so that coloring by the nozzle array 10*a*, coloring by the nozzle array 10*b*, and capping by the cap 21 on the nozzle surface 12 are possible. The movement direction Y of the head is the same as that of the apparatus depth direction illustrated in FIG. 1.

Similarly for the other heads, the heads 1K to 1Y of each color can be moved freely in the head moving direction for the selection of the nozzle array to be used and the maintenance operation.

Further, as illustrated in FIGS. 3 and 5A to 6, there are two rows of nozzle arrays 10*a* and 10*b* on the lower surface of the head 1, and the nozzle array to be used for ejecting ink droplets to land on the thread and to color the thread, can be selected by moving the head 1 and setting the nozzle array to perform the ejection directly above the thread.

The maintenance unit 20K not only performs the recovery operation by capping the nozzles with the cap 21, but also collects ink that does not land on the thread 101, such as the ink that has missed the thread 101 or that has been ejected for idle ejection, at a collection surface 22 that is the top surface where the cap 21 is not provided. In the present embodiment, the collection surface 22 functions as an idle ejection receiver (an example of an ejection receiver) for receiving idle ejection droplets that are ejected for purposes other than for coloring the thread 101.

As a reference for moving the head 1, a home position sensor (HP sensor) 305 is provided in the maintenance unit 20. FIGS. 5A to 5C illustrate an example in which the HP sensor 305 defining the position of the home position of the head 1 is provided at the edge portion of the maintenance unit 20, but the HP sensor 305 may be provided at another position in the head movement direction.

Further, as illustrated in FIG. 6, the respective positions of the plurality of heads 1K to 1Y can be individually moved in the direction of ±Y. Further, in the liquid ejecting apparatus according to the present embodiment, the conveying direction of the thread 101 being conveyed (ejection target medium) is parallel to each of the nozzle arrays 10*a* and 10*b*, and at a predetermined timing, some of the heads among the plurality of heads 1K to 1Y (plurality of ejection heads) are moved to a position facing the thread 101 and to eject droplets to the thread 101, and at the same time, the remaining heads among the plurality of heads 1K to 1Y (plurality of ejection heads) are moved to be withdrawn from the position facing the thread 101 and to eject droplets toward the collection surface 22 (ejection receiver) (see FIGS. 5 and 6).

Figure 7:
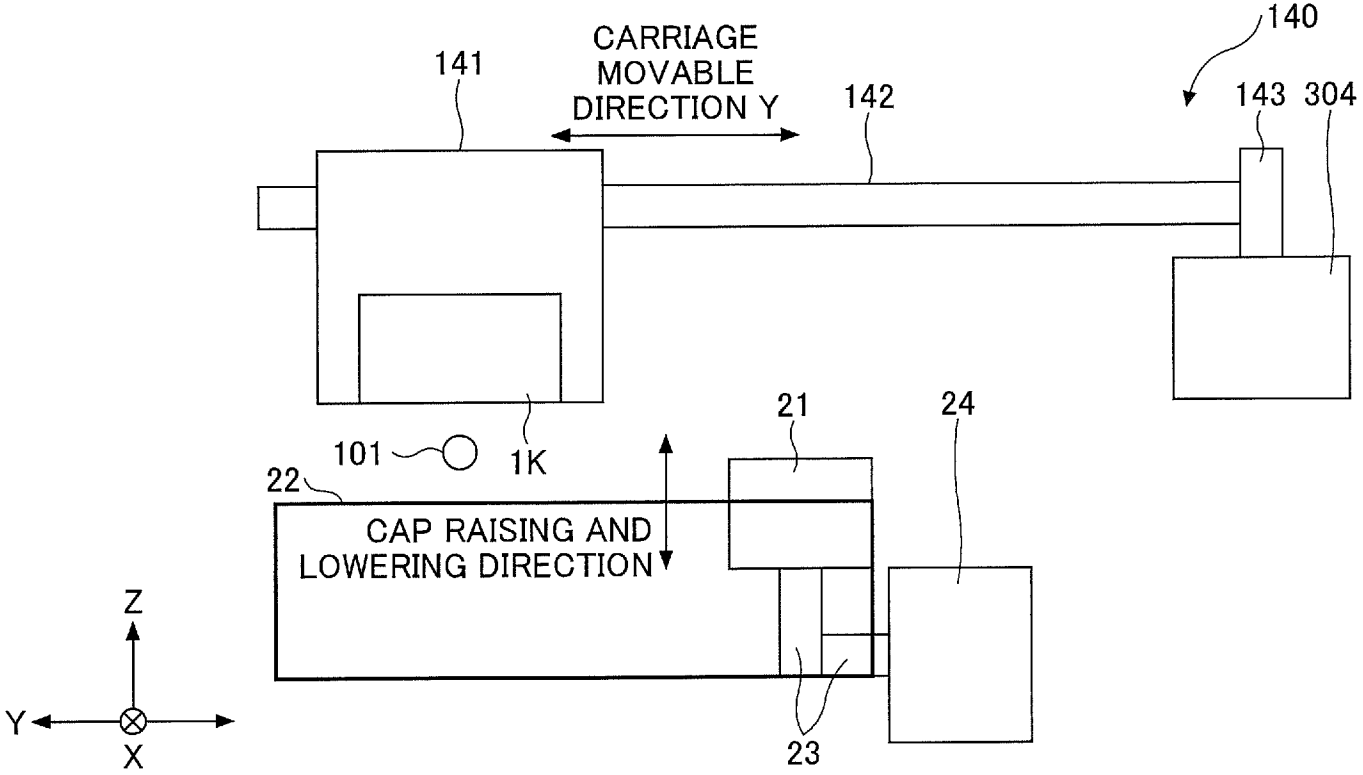
FIG. 7 is a schematic explanation diagram of the head moving unit of the liquid applying unit and the cap moving unit of the maintenance unit according to the first embodiment of the present invention.

Here, a mechanism for moving the respective heads 1K to 1Y in the movement direction (the apparatus depth direction) will be described with reference to FIG. 7. FIG. 7 is a schematic explanation diagram of the head moving means of the liquid applying unit 103 and the moving means of the cap 21 of the maintenance unit 20.

As illustrated in FIG. 7, the head 1 is supported by a movable carriage 141. The carriage 141 can be moved in a movable direction, as arms 142 and 143, which support the carriage 141, are moved by a head moving motor 304. As an example of head movement, for example, the horizontally extending arm 142 itself may be expanded or contracted, or the carriage 141 may move by changing the position of the carriage 141 relative to the arm 142. In the present embodiment, the carriage 141, the arms 142 and 143, and the head moving motor 304 are combined to form a head moving unit 140.

By such a structure, the head 1K supported by the carriage 141 can be moved to the position of the cap 21 at the time of the standby state, and can be moved to the position of the thread 101 at the time of performing coloring, and can be moved to a position facing the collection surface 22 (idle ejection receiver) at the time of performing idle ejection.

The head moving unit 140, which is a movable portion for moving the position of the head 1, is preferably provided for each head. Accordingly, the timing of idle ejection can be changed for each head.

The cap 21 can be raised and lowered in the maintenance unit 20 by a raising/lowering arm 23 driven by a cap raising/lowering motor 24. In order to prevent the ink in the head 1K from drying during the standby state, the cap 21 is raised to cap the head 1, as illustrated in FIG. 5C. At the time of performing coloring, the cap 21 is lowered to perform decapping as illustrated in FIGS. 5A and 5B.

In FIGS. 5A to 5C, an example in which the cap 21 is disposed at the back side (+Y side) of the coloring/embroidery apparatus 1000 in the maintenance unit 20 is illustrated. However, as illustrated in FIG. 7, the cap 21 may be disposed on the front side (−Y side) of the coloring/embroidery apparatus 1000 in the maintenance unit 20.

<Control Block>

Figure 8:
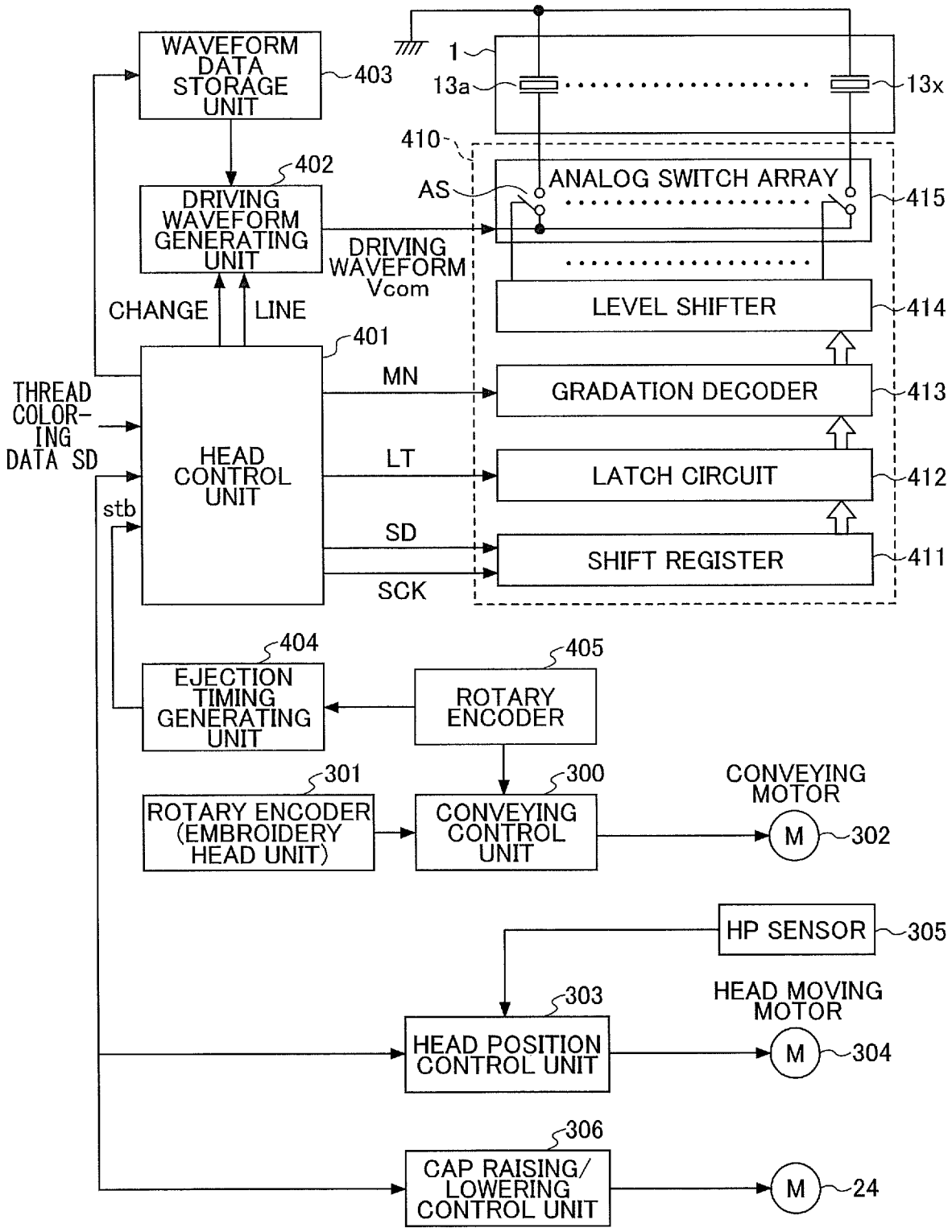
FIG. 8 is a control block diagram of the portion related to droplet ejection and idle ejection control of the liquid ejecting apparatus according to the first embodiment of the present invention.

FIG. 8 is a control block diagram illustrating the portion related to the control of liquid ejection and idle ejection in the liquid ejecting apparatus according to the first embodiment of the present invention.

The head 1 includes a plurality of piezoelectric elements 13 as pressure generating elements that generate pressure for ejecting liquid from a plurality of the nozzles 11. A driving waveform applying means for applying a driving waveform to the head 1 includes a head control unit 401, a driving waveform generating unit 402, a waveform data storage unit 403, a head driver 410, and an ejection timing generating unit 404 for generating an ejection timing.

The conveying control means includes a conveying control unit 300, a rotary encoder 405 of the conveying roller 109, a rotary encoder 301 on the embroidery head side, and a conveying motor 302.

A head position control means includes a head position control unit 303, the head moving motor 304, and the HP sensor 305.

Upon receiving an ejection timing pulse stb, the head control unit 401 outputs an ejection synchronization signal LINE, which triggers the generation of a driving waveform, to the driving waveform generating unit 402. The head control unit 401 outputs an ejection timing signal CHANGE corresponding to a delay amount from the ejection synchronization signal LINE, to the driving waveform generating unit 402.

The driving waveform generating unit 402 generates the ejection synchronization signal LINE and a common driving waveform Vcom at a timing based on the ejection timing signal CHANGE.

The head control unit 401 receives thread coloring data and generates a mask control signal MN for selecting a predetermined waveform of the common driving waveform signal Vcom according to the size of the liquid droplet ejected from each of the nozzles 11 of the head 1 based on the thread coloring data. The mask control signal MN is a timing signal synchronized with the ejection timing signal CHANGE.

The head control unit 401 transfers thread coloring data SD, a synchronization clock signal SCK, a latch signal LT that instructs the latching of the thread coloring data, and the generated mask control signal MN, to the head driver 410.

The head driver 410 includes a shift register 411, a latch circuit 412, a gradation decoder 413, a level shifter 414, and an analog switch array 415.

The shift register 411 inputs the thread coloring data SD and the synchronization clock signal SCK transmitted from the head control unit 401. The latch circuit 412 latches each registration value of the shift register 411 by a latch signal LT transferred from the head control unit 401.

The gradation decoder 413 decodes the value (thread coloring data SD) latched by the latch circuit 412 and the mask control signal MN and outputs the result of the decoding. The level shifter 414 converts the level of the logic level voltage signal of the gradation decoder 413 to a level at which an analog switch AS of the analog switch array 415 is operable.

The analog switch AS of the analog switch array 415 is a switch that turns on/off according to the output of the gradation decoder 413 provided via the level shifter 414. The analog switch AS is provided for each of the nozzles 11 included in the head 1, and is connected to the individual electrode of the piezoelectric element 13 corresponding to each of the nozzles 11. Further, the analog switch AS receives the common driving waveform signal Vcom from the driving waveform generating unit 402. The timing of the mask control signal MN is synchronized with the timing of the common driving waveform Vcom.

Accordingly, the ON/OFF of the analog switch AS is switched at an appropriate timing in accordance with the output of the gradation decoder 413 provided via the level shifter 414, so that a waveform applied to the piezoelectric element 13 corresponding to each of the nozzles 11 is selected from among the driving waveforms forming the common driving waveform signal Vcom. As a result, the size of the droplets ejected from the nozzle is controlled.

The ejection timing generating unit 404 generates and outputs an ejection timing pulse stb every time the thread 101 is moved a predetermined amount, from the detection result of the rotary encoder 405 for detecting the rotation amount of the conveying roller 109 of FIG. 1.

Here, the thread 101 is conveyed (thread feeding) as the thread is consumed in the embroidery operation by the embroidery head 106 on the downstream side. The rotary encoder 301 on the downstream side of the embroidery head 106 is a feed amount detecting means for detecting the movement amount of the thread 101 in the embroidery head 106.

When the thread 101 is conveyed, the conveying roller 109 guiding the thread 101 rotates so that the encoder wheel 405*b* of the rotary encoder 405 rotates, and an encoder pulse proportional to the linear speed of the thread 101 is generated and output from the encoder sensor 405*a*.

The ejection timing generating unit 404 generates the ejection timing pulse stb by the encoder pulse from the rotary encoder 405, and uses the ejection timing pulse stb as the ejection timing of the head 1. The liquid is applied to the thread 101 from when the thread 101 starts moving. Even if the linear velocity of the thread 101 is changed, the intervals of the ejection timing pulses stb are changed according to the encoder pulse, thereby preventing the displacement of landing positions of the droplets.

The conveying control unit 300 is an example of a conveying control means. The conveying speed of the thread 101 is determined based on the movement amount of the rotary encoder 301 at the downstream side, and the conveying roller 108 is rotated by the conveying motor 302 so that the thread is conveyed at a determined conveying speed. The rotary encoder 405 detects the speed and controls the thread conveyance by the conveying motor 302.

The head position control unit 303 is an example of a head position control means. The head position control unit 303 rotates the head moving motor 304 based on a head position instruction from the head control unit 401 to move the heads 1K to 1Y to a predetermined position.

For example, in a case where the head moving motor 304 is a stepping motor, the position is controlled by controlling the rotation of the head moving motor 304, from a state where the home position (HP) is detected by the HP sensor 305, to rotate the head moving motor 304 by an amount corresponding to a number of steps according to the distance from the position of the HP to a position where coloring is performed by the nozzle array 10*a*, to a position where coloring is performed by the nozzle array 10*b*, to a capping position, and the like. The head position control unit 303 reports, to the head control unit 401, that the head movement is completed after completing the rotating corresponding to the number of steps according to the distance.

A cap raising/lowering control unit 306 rotates the cap raising/lowering motors 24K to 24Y and raises/lowers the caps 21K to 21Y, based on a capping or decapping instruction from the head control unit 401.

For example, when the cap raising/lowering motor 24 is a stepping motor, the cap raising/lowering control unit 306 implements control to rotate the cap raising/lowering motor 24 by an amount corresponding to a number of steps corresponding to the distance between the capping position, which is the upper end, and the decapping position, which is the lower end. After the cap raising/lowering motor 24 is rotated by an amount corresponding to the number of steps according to the distance from the upper end to the lower end, the cap raising/lowering control unit 306 reports, to the head control unit 401, that capping or decapping of the nozzle array by the raising/lowering of the cap 21, has been completed.

<Functional Blocks>

Figure 9:
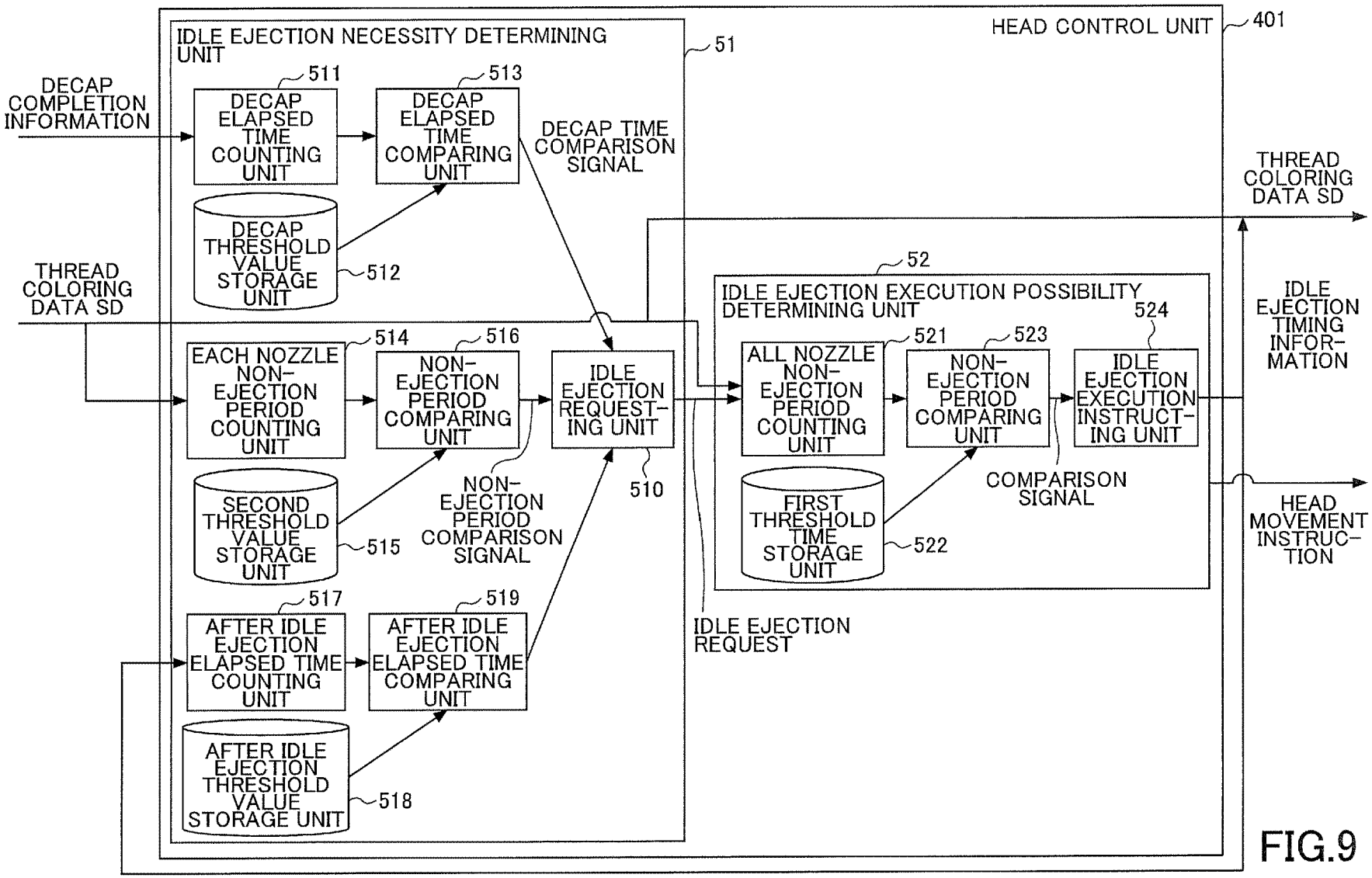
FIG. 9 is a functional block diagram of the head control unit according to a first control example according to the first embodiment of the present invention.

FIG. 9 is a functional block diagram illustrating an idle ejection necessity determining unit 51 and an idle ejection execution possibility determining unit 52 included in the head control unit 401 of FIG. 8 according to the first embodiment.

Generally, in a nozzle array during the coloring operation, some nozzles are not used and do not perform an ejection operation depending on the coloring condition (thread coloring data), and, therefore, the viscosity of the ink (liquid) increases (becomes thick) within the nozzle due to the nozzle being decapped for a long period of time, which may cause the ejection to become unstable. Accordingly, in the first embodiment of the present invention, in the thread coloring data, the time is counted and the time period when it is necessary for moving and performing idle ejection is set as a threshold value (threshold time), and when there is a portion in the coloring data corresponding to such a time period, a maintenance and recovery operation is performed in which the head is moved to be withdrawn, idle ejection is performed, and the head is moved to be returned.

The head control unit 401 has a function for detecting (determining) in advance whether idle ejection is necessary during ejection by the nozzles and a function for determining whether an idle ejection operation is executable during the time period in which idle ejection is determined to be necessary.

Therefore, the head control unit 401 includes the idle ejection necessity determining unit 51 and the idle ejection execution possibility determining unit 52 in an executable manner.

The idle ejection necessity determining unit 51 determines whether an idle ejection operation is necessary in a nozzle array that is positioned above the thread and that is performing a coloring operation, based on the elapsed time after decapping, the elapsed time after idle ejection, the non-ejection period during ejection in consideration of the coloring condition, and the like.

After it is determined that idle ejection is necessary, the idle ejection execution possibility determining unit 52 counts (calculates) a non-ejection period during which all of the nozzles do not perform ejection in the thread coloring data and compares the non-ejection period with a predetermined threshold value (the time required for performing a maintenance/recovery operation). When the non-ejection period is greater than or equal to the threshold value, the idle ejection execution possibility determining unit 52 determines that idle ejection is executable and instructs the execution of an idle ejection operation.

Specifically, the idle ejection necessity determining unit 51 includes a decap elapsed time counting unit 511, a decap threshold value storage unit 512, a decap elapsed time comparing unit 513, an each nozzle non-ejection period counting unit 514, a second threshold value storage unit 515, a non-ejection period comparing unit 516, an after idle ejection elapsed time counting unit 517, an after idle ejection threshold value storage unit 518, an after idle ejection elapsed time comparing unit 519, and an idle ejection requesting unit 510, in an executable manner.

When starting a coloring operation due to the generation of a coloring request, and the nozzle arrays 10*a* and 10*b* are decapped, the decap elapsed time counting unit 511 counts the elapsed time after the decapping. Therefore, when starting the coloring, upon receiving, from the cap raising/lowering control unit 306, decapping completion information indicating that the cap 21 has been lowered and the decapping has been done, the decap elapsed time counting unit 511 starts the counting.

Then, the decap elapsed time comparing unit 513 compares the counted decap elapsed time with a threshold value (predetermined time) stored in the decap threshold value storage unit 512, and when the elapsed time exceeds the threshold value, the decap elapsed time comparing unit 513 sets the decap time comparison signal to Hi.

The each nozzle non-ejection period counting unit 514 counts the non-ejection period of each non-ejection nozzle when there is a non-ejection nozzle among the nozzles in the nozzle array performing an ejection operation, located above the thread. For this reason, data (thread coloring data SD) that is the source of the ejection operation is input to the each nozzle non-ejection period counting unit 514, and the non-ejection period of the nozzle assigned in the coloring data, is counted.

Specifically, with respect to the nozzle array performing the ejection operation for coloring, there may be cases where the ejection operation is not performed depending on the coloring condition. Specifically, when droplets are ejected from all of the nozzles of the nozzle array for coloring, such as when solidly coloring the thread, there will be no non-ejection period, and, therefore, the counting does not start. On the other hand, for example, in a case where a stripe pattern is formed on a thread based on the thread coloring data SD, there will be nozzles to be used and nozzles not to be used in the nozzle array 10*a*.

Alternatively, when one nozzle array of each of the heads of the plurality of colors, i.e., the nozzle arrays 10*a*K, 10*a*C, 10*a*M, and 10*a*Y of the corresponding heads 1K, 1C, 1M, and 1Y, is present above the thread 101, and the color that is used for coloring the thread 101 is a primary color, there will be heads of certain colors that will not be used. In this case, in the heads of the colors that are not used, all of the nozzles in the nozzle array above the thread will be in a non-ejection state.

As described above, the each nozzle non-ejection period counting unit 514 counts the non-ejection period during which each nozzle of the nozzle array located above the thread during the coloring operation, is not used for ejection.

The non-ejection period comparing unit 516 compares the counted non-ejection period with a second threshold value (a predetermined time) stored in the second threshold value storage unit 515, and when the non-ejection period exceeds the second threshold value, the non-ejection period comparing unit 516 sets the non-ejection period comparison signal to Hi.

Here, a predetermined time or a predetermined number of dots corresponding to the second threshold value of the non-ejection period for determining whether an idle ejection necessity condition for a nozzle is satisfied, is preferably variable, depending on the type of droplet, the temperature, and/or the operation mode.

For example, the viscosity of the ink varies depending on the type of droplet and the temperature, and, therefore, the time until idle ejection is determined as necessary will vary. Further, the driving frequency varies depending on the operation mode, and, therefore, when the non-ejection period is counted by dots, the number of ejected dot droplets varies even for the same time (period). Therefore, by being able to vary the condition for determining the necessity of a maintenance operation, it is possible to address various conditions.

The after idle ejection elapsed time counting unit 517 counts the elapsed time after idle ejection, which is after the nozzle array in use performs the idle ejection. Therefore, the after idle ejection elapsed time counting unit 517 starts counting the elapsed time immediately after the timing when the idle ejection droplets are ejected.

The after idle ejection elapsed time comparing unit 519 compares the counted elapsed time after idle ejection with a threshold value (a predetermined time) stored in the after idle ejection threshold value storage unit 518 and sets the after idle ejection comparison signal to Hi when the elapsed time exceeds the threshold value.

The decap elapsed time counting unit 511 clears the count at the time of capping, for example. The each nozzle non-ejection period counting unit 514 clears the count at the timing when a droplet is ejected by each nozzle, and then starts counting from 0 at the timing when an idle ejection period starts after the droplet ejection ends. The after idle ejection elapsed time counting unit 517 clears the count at the timing when the idle ejection is executed and starts the counting from 0 after the idle ejection ends.

Note that the timing of clearing the above-described count is an example, and the timing of clearing the count or the timing of starting the counting may be set such that the decap elapsed time counting unit 511, the each nozzle non-ejection period counting unit 514, and the after idle ejection elapsed time counting unit 517 operate in conjunction with each other, or may be set in consideration of other factors. For example, the each nozzle non-ejection period counting unit 514 may clear the count at the time when the idle ejection is executed. At the time of liquid ejection, the timing of starting the counting after clearing the count may be changed between the case where one droplet is ejected and a case where multiple droplets are ejected.

When the decap time comparison signal, the non-ejection period comparison signal, and/or the after idle ejection comparison signal becomes Hi, the idle ejection requesting unit 510 sets the idle ejection request to Hi. Specifically, when either the decap time comparison signal or the non-ejection period comparison signal becomes Hi immediately after the start of coloring, the idle ejection request signal becomes Hi. When either the non-ejection period comparison signal or the after idle ejection comparison signal becomes Hi after performing the idle ejection operation after starting coloring, the idle ejection request signal becomes Hi.

When the idle ejection request signal becomes Hi, the idle ejection execution possibility determining unit 52 determines whether the head can execute the idle ejection operation.

The idle ejection execution possibility determining unit 52 includes an all nozzle non-ejection period counting unit 521, a first threshold time storage unit 522, a non-ejection period comparing unit 523, and an idle ejection execution instructing unit 524 in an executable manner.

The all nozzle non-ejection period counting unit 521 is an example of the counting unit, and when there is a timing at which all nozzles of the nozzle array performing the ejection operation positioned above the thread 101, are in a non-ejection state (do not perform ejection), the all nozzle non-ejection period counting unit 521 counts the non-ejection period in which all nozzles are in a non-ejection state. Therefore, the data (thread coloring data SD) that is the source of the ejection operation is input to the all nozzle non-ejection period counting unit 521, and the "time period during which all of the nozzles do not perform ejection" of the nozzle array, assigned in the coloring data, is counted for each head.

The non-ejection period comparing unit 523 is an example of the comparing unit and compares the counted non-ejection period with the first threshold value (first threshold time) stored in the first threshold time storage unit 522. When the non-ejection period exceeds the first threshold value, the comparison signal is set to Hi.

In the present embodiment, the time of the first threshold value used by the idle ejection execution possibility determining unit 52 is set to a time required for the withdrawal movement of the head, the idle ejection to an idle ejection receiver, and the returning movement of the head in an idle ejection operation. On the other hand, the times of the threshold values (predetermined times) stored in the decap threshold value storage unit 512, the second threshold value storage unit 515, and the after idle ejection threshold value storage unit 518 used by the idle ejection necessity determining unit 51 are set to times at which a risk of thickening arises due to the nozzle being left unused. Therefore, various thresholds (predetermined times) used by the idle ejection necessity determining unit 51 are much longer than the first threshold time used by the idle ejection execution possibility determining unit 52.

When the comparison signal becomes Hi, the idle ejection execution instructing unit 524 instructs the execution of idle ejection. The idle ejection execution instruction includes an instruction to be sent to the driving waveform generating unit 402 to change the coloring data SD to "perform ejection" data at a timing for causing ejection at an idle ejection timing with respect to the head to execute idle ejection, and an instruction to be sent to the head position control unit 303 to cause a withdrawal movement and a returning movement of the corresponding head with respect to the thread 101. With reference to FIGS. 13 to 16, a detailed description is given of the thread coloring data at the time of executing idle ejection.

The specific control of the ejection and maintenance and recovery operation executed by the head control unit 401 having the above function will be described later with reference to the flowcharts of FIGS. 11 and 12 and the explanatory diagrams of FIGS. 13 to 16.

Example of Hardware Configuration

Figure 10:
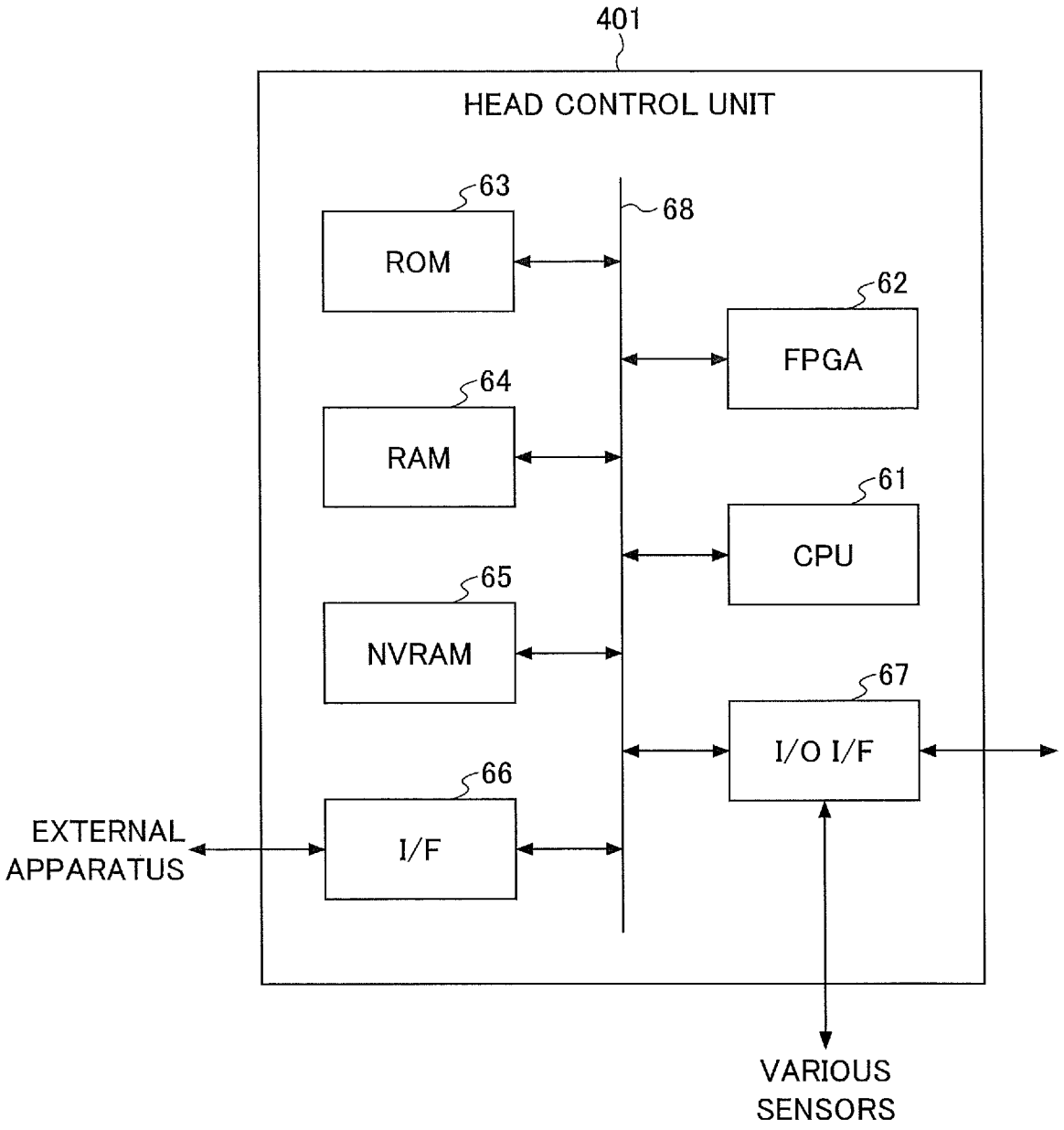
FIG. 10 is an example of a hardware block diagram of a head control unit according to the first embodiment of the present invention.

Next, the hardware configuration of the head control unit 401 will be described with reference to FIG. 10. FIG. 10 is an example of a hardware block diagram of the head control unit 401.

As illustrated in FIG. 10, in the head control unit 401, a Central Processing Unit (CPU) 61, a Field-Programmable Gate Array (FPGA) 62, a Read-Only Memory (ROM) 63, a Random Access Memory (RAM) 64, a Non-Volatile (NV) RAM 65, an interface (I/F) 66, and an input/output (I/O) I/F 67 are connected via a memory bus 68. The memory bus 68 may be separated into a plurality of buses.

In the head control unit 401, the CPU 61 controls the ejection by the liquid ejecting apparatus 100. The ROM 63 stores various kinds of information and control programs. The RAM 64 is used as a work area when various operations are executed.

For example, the CPU 61 uses the RAM 64 as a work area to execute various control programs stored in the ROM 63 and outputs control instructions for controlling various operations in the liquid ejecting apparatus 100 or the coloring/embroidery apparatus 1000. In this case, by communicating with the FPGA 62, the CPU 61 cooperates with the FPGA 62 to implement various kinds of operation control in the liquid ejecting apparatus 100.

The FPGA 62 includes the functions of the idle ejection necessity determining unit 51 and the idle ejection execution possibility determining unit 52 illustrated in FIG. 9 in an executable manner. Note that FIG. 10 illustrates an example in which one FPGA 62 is provided; however, two FPGAs may be separately provided for executing the idle ejection necessity determining unit 51 and the idle ejection execution possibility determining unit 52, respectively.

The NVRAM 65 stores apparatus-specific information and updatable information, etc. For example, in the NVRAM 65, the time required for the withdrawal and the returning movement of the head is stored in advance. The NVRAM 65 may be in a removable form.

The I/F 66 mediates the exchange of information with an external device such as a host computer. The I/O I/F 67 mediates the exchange of information with various units within the apparatus. The I/O I/F 67 may be connected to the driving waveform generating unit 402, an input/output device such as an operation panel, various sensors, and the like. The various sensors include, for example, the HP sensor 305 of the carriage 141 and a sensor for detecting an internal environment of an apparatus such as the temperature or the humidity that affects the determination of the need for idle ejection.

In the first embodiment of the present invention, the number of dots for which ejection is not performed (the non-ejection period) in the thread coloring data is calculated by the FPGA 62. With this configuration, even when the liquid ejecting apparatus is connected with an information processing apparatus that outputs thread coloring data (the source data) as a client PC, the client PC (the rendering side) does not need to have a counting function, and the client PC is able to provide versatility to the rendering software.

Figure 11:
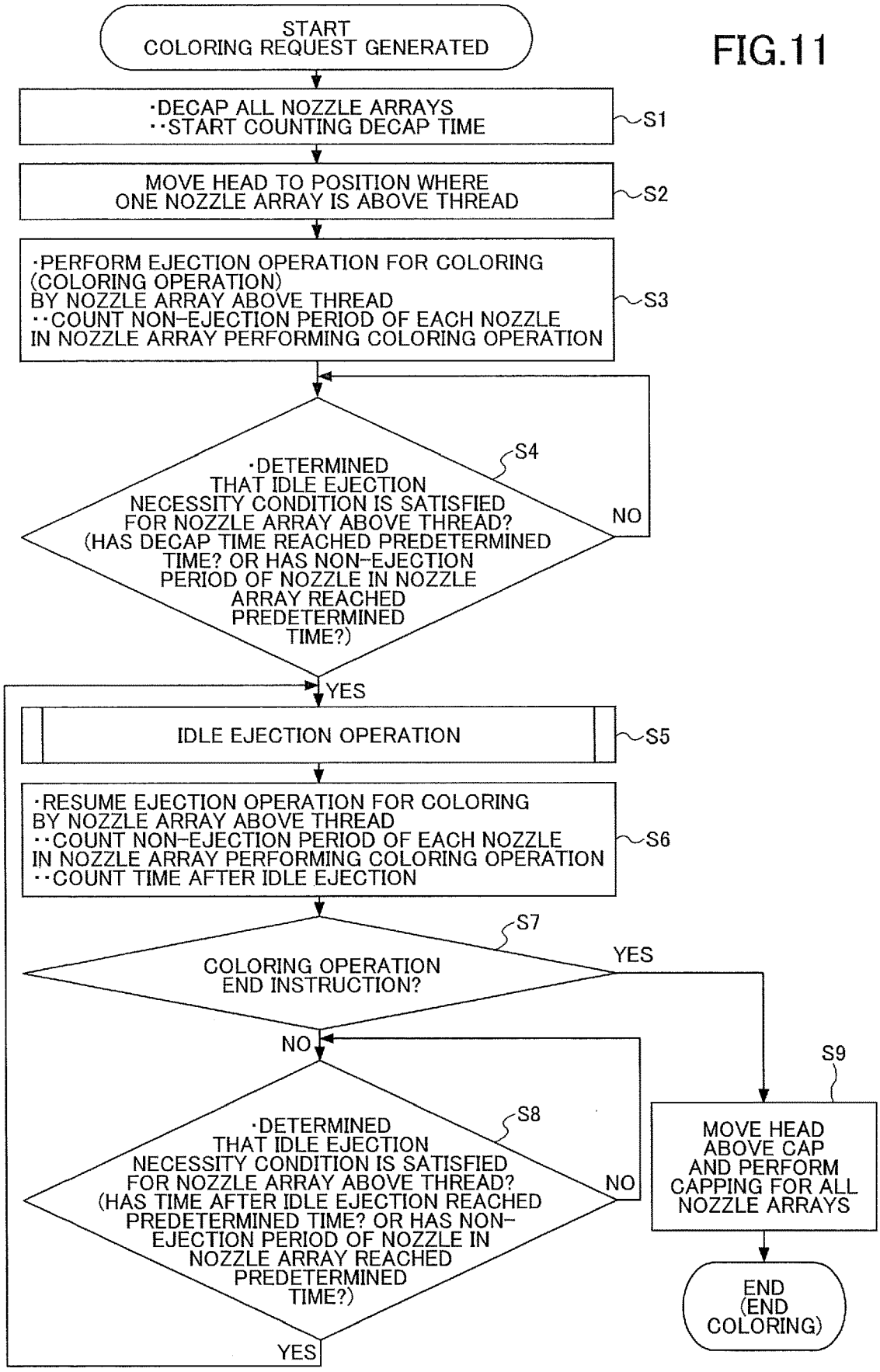
FIG. 11 is a schematic flowchart including the determination of whether idle ejection is necessary according to the first control example performed according to the first embodiment of the present invention.

In FIGS. 9 to 11, an example in which all functions of the head control unit are provided in the liquid ejecting apparatus has been described. However, a client PC (an information processing apparatus 9 of FIG. 21) connected to the coloring/embroidery apparatus 1000 may include some or all of the functions of the head control unit.

<Control Flow Chart>

Next, the control flow according to an embodiment of the present invention will be described with reference to FIGS. 11 and 12. FIG. 11 is a schematic flowchart including determination of the idle ejection necessity according to a first control example of an embodiment of the present invention.

This flow starts upon receiving a coloring request, and in step S1, all of the nozzle arrays 10*a* and 10*b* are decapped upon detecting the generation of the coloring request, and the decap elapsed time counting unit 511 starts counting the decap time.

In step S2, the head is moved such that a nozzle array (e.g., the nozzle array 10*a*) for executing a coloring operation is positioned above the thread 101 (FIG. 5C→FIG. 5A).

In step S3, the coloring operation is executed by applying a coloring pulse or a fine driving pulse based on the thread coloring data SD, to the piezoelectric elements 13*a* to 13*x* of the nozzle array 10*a* performing the coloring operation disposed above the thread 101. At this time, the each nozzle non-ejection period counting unit 514 counts the non-ejection period of each nozzle of the nozzle array 10*a* above the thread performing ejection operation.

Then, the coloring operation continues in the nozzle array 10*a* until it is determined that "idle ejection is necessary" in the nozzle array 10*a* performing the coloring operation (the result of step S4 becomes YES).

Here, in step S4, for the nozzle array 10*a* performing the coloring operation, the head control unit 401 determines whether idle ejection is necessary (whether the idle ejection necessity condition is satisfied). Specifically, the head control unit 401 determines whether the following necessity conditions are satisfied for each head.

When the elapsed time of the acquired time from the stored decap time is calculated, the calculated time is compared with a previously stored threshold value, and it is determined that "the elapsed time of the decapped state has exceeded the threshold value".

When the number of dots for which ejection is not performed based on the thread coloring data is compared with a previously stored threshold value, and it is determined that "the time that a certain nozzle has not performed ejection has exceeded the threshold value".

Alternatively, when the number of dots for which ejection is not performed based on the thread coloring data is compared with a previously stored threshold value, the ranking in the order of the coloring data exceeding the threshold value is extracted, and it is determined that "the time that nozzles of a particular number of or more have not performed ejection has exceeded the threshold value".

In the head control unit 401, it is determined that the idle ejection necessity condition is satisfied, that is, it is determined that idle ejection is necessary, at a timing when either the decap time comparison signal or the non-ejection period comparison signal becomes Hi.

When it is determined that idle ejection is necessary in the nozzle array 10*a* performing the coloring operation (YES in step S4), the idle ejection operation is performed in step S5. Details of the idle ejection operation are described in detail with reference to FIG. 12.

In step S6, the coloring operation is resumed by applying a coloring pulse or a fine driving pulse based on the thread coloring data SD, to the piezoelectric element 13 of each nozzle of the nozzle array 10*a* for which the idle ejection has been completed. At this time, the each nozzle non-ejection period counting unit 514 counts the non-ejection period of each nozzle of the nozzle array 10*a* above the thread performing the ejection operation in the thread coloring data SD. Further, the elapsed time after idle ejection is counted.

When an instruction to end the coloring operation is given in step S7, in step S9, the head 1 is moved to the position of the cap 21, and all of the nozzle arrays are capped and the color operation is ended.

On the other hand, when an instruction to end the coloring operation is not given, the coloring operation is continued in the nozzle array 10*a* until it is determined that "idle ejection is necessary" in the nozzle array 10*b* performing the coloring operation in step S8.

Note that in the determination by the head control unit 401 in step S8 after performing the idle ejection operation one or more times, it is determined that the idle ejection necessity condition is satisfied at a timing when either an after idle ejection time comparison signal or an idle ejection time comparison signal becomes Hi. The determination by the head control unit 401 in step S8 is made after idle ejection is executed after decapping, and, therefore, the determination is made by using an after idle ejection time comparison signal instead of an after decap time comparison signal.

The after idle ejection time comparison signal becomes Hi when the elapsed time of the acquired time from the previously stored time of the maintenance/recovery operation is calculated, the calculated time is compared with a previously stored threshold value, and it is determined that the elapsed time from the previous maintenance/recovery operation exceeds the threshold value.

When it is determined in step S8 as "idle ejection necessary" for the nozzle array 10*a* performing the coloring operation, the process returns to before step S5 and an idle ejection operation is performed with respect to the nozzle array 10*a* in step S5.

Steps S5, S6, and S8 described are repeated until the coloring operation ends (until the result of step S7 becomes YES).

Figure 12:
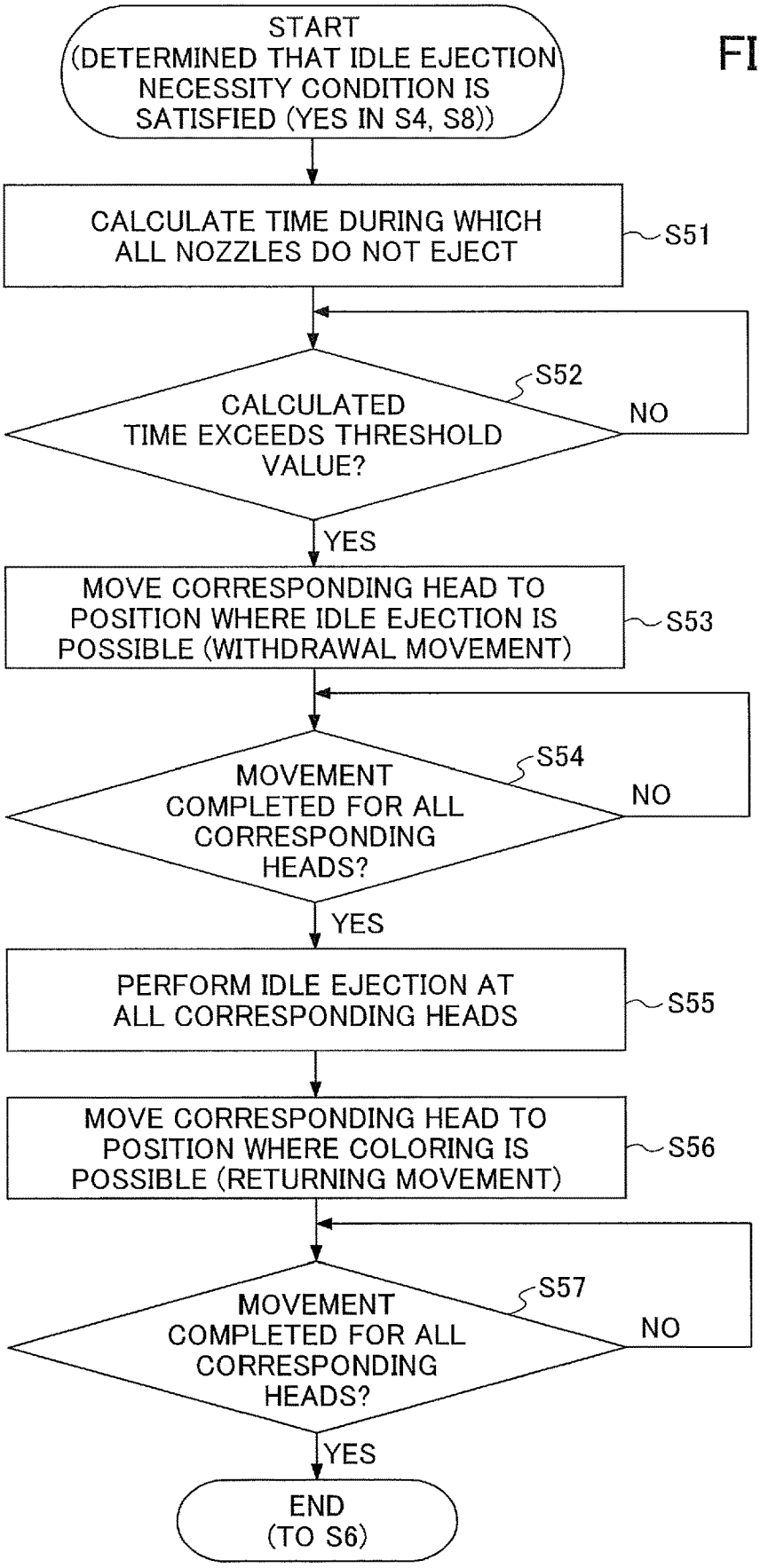
FIG. 12 is a detailed flowchart of an idle ejection execution operation according to the first embodiment of the present invention.

FIG. 12 is a detailed flowchart of an idle ejection execution operation according to a first control example of an embodiment of the present invention. When it is determined as "idle ejection necessary" (YES) in steps S4 and S8 of FIG. 11, the process proceeds to step S5 and the flow of FIG. 12 starts.

For each head determined as "idle ejection necessary" in step S51, the time during which all nozzles do not perform ejection (the non-ejection time) is calculated. Specifically, the non-ejection time is calculated by counting the number of dots (the number of ejection timings) for which the nozzle array ejection is not performed in the coloring data. Here, the time is calculated by the number of dots divided by the driving frequency. Alternatively, the time may not be calculated and the number of dots of non-ejection may be counted directly as the non-ejection period.

In step S52, it is determined whether the non-ejection time calculated for each head, exceeds a threshold value. When there is a head for which the non-ejection time exceeds the threshold value, the process proceeds to step S53. When there is no head for which the non-ejection time exceeds the threshold (NO in step S52), the counting is continued until the threshold is exceeded for each head.

In step S53, a corresponding head that is determined to exceed the threshold in step S52, is moved to a position where idle ejection is possible. The position where idle ejection is possible is a position where the nozzle array performing the coloring operation is withdrawn from the position facing the thread 101.

The movement of the head may be started immediately after the result of step S52 becomes YES, but the movement of the head may waited for a predetermined standby time before the idle ejection, or the movement of the head may be started upon making adjustments in the ejection amount for the idle ejection operation. For example, when the period without ejection (non-ejection period) is significantly longer than the threshold value, the idle ejection amount (the number of idle ejection droplets) may be set to be larger, and idle ejection may be performed immediately before the end of the period without ejection.

In step S54, it is determined whether all of the corresponding heads that are to perform idle ejection at this timing, have moved to a position where idle ejection is possible. When it is determined that the heads have moved (YES in step S54), the process proceeds to step S55. When it is determined that the heads have not moved (NO in step S54), the head movement is continued until the head to execute the idle ejection reaches a predetermined idle ejection position.

As a method of determining whether the head has moved to the idle ejection position, for example, in the case of a stepping motor, it is determined whether a predetermined number of pulses of a plurality of stepping motors required for all of the corresponding heads to be moved to the position where idle ejection is possible, have been completed. Alternatively, an encoder sensor may be installed in the head moving motor to determine the distance of movement calculated from the phase and the number of encoder pulses. Alternatively, a photo sensor may be provided at the movement position, and the determination may be made when a filler attached to the head moves to block the light of the photo sensor.

When it is detected that the head to execute idle ejection has reached a predetermined idle ejection position (YES in step S54), in step S55, idle ejection is performed to eject droplets to the collection surface 22, that is an idle ejection receiver, by all of the corresponding heads.

When ejection is completed, in step S56, all of the corresponding heads that have performed the idle ejection are moved to a position where coloring is possible. The position where coloring is possible is a position where the nozzle array 10*a* for performing the coloring operation faces the thread 101.

In step S57, it is determined whether all of the corresponding heads that have performed idle ejection have moved to the position where coloring is possible. When it is determined that the heads have not moved (NO in step S57), the head movement is continued until all of the heads that have executed idle ejection reaches the predetermined coloring position.

The determination can be made as in step S54, by the completion of a predetermined number of pulses of a stepping motor, the movement distance calculated from the output result of an encoder sensor, the blocking of the light of a photo sensor, and the like.

When it is determined that the heads have returned to the coloring position (YES in S57), the idle ejection operation is ended, the process proceeds to step S6 in FIG. 11, and the coloring operation is resumed using the nozzle array for which idle ejection has been completed.

As described above, in an embodiment of the present invention, when the number of dots (time) for which ejection is not performed is calculated from the thread coloring data, and the number of dots (time) for which ejection is not performed by all of the nozzle arrays of the corresponding head is greater than or equal to a predetermined threshold value (time required to perform a maintenance/recovery operation), only the nozzle arrays of the corresponding head are withdrawn from the position of scanning the thread, and are caused to eject idle ejection droplets, and then these nozzle arrays are returned to the position of scanning the thread. Thus, it is possible to perform the maintenance/recovery operation without stopping the thread conveyance.

In the present invention, as illustrated in FIG. 11, after it is determined that idle ejection is necessary, the counting for executing idle ejection is started. Therefore, even when the thread coloring data includes data in which the number of dots (time) of non-ejection is greater than or equal to a predetermined threshold value, idle ejection does not need to be performed during the period where idle ejection is determined as not necessary, that is, until idle ejection is determined to be necessary. Therefore, excessive implementation of idle ejection can be prevented.

Further, the head moving unit 140 that moves the position of the head 1 is provided for each head, so that the timing of the idle ejection can be changed for each head. For example, idle ejection may be performed from a nozzle array above the thread 101 in a head of a color that is temporarily not used for a period of threshold value, while another head is ejecting droplets onto the thread. This head-by-head control is described below.

Figure 13:
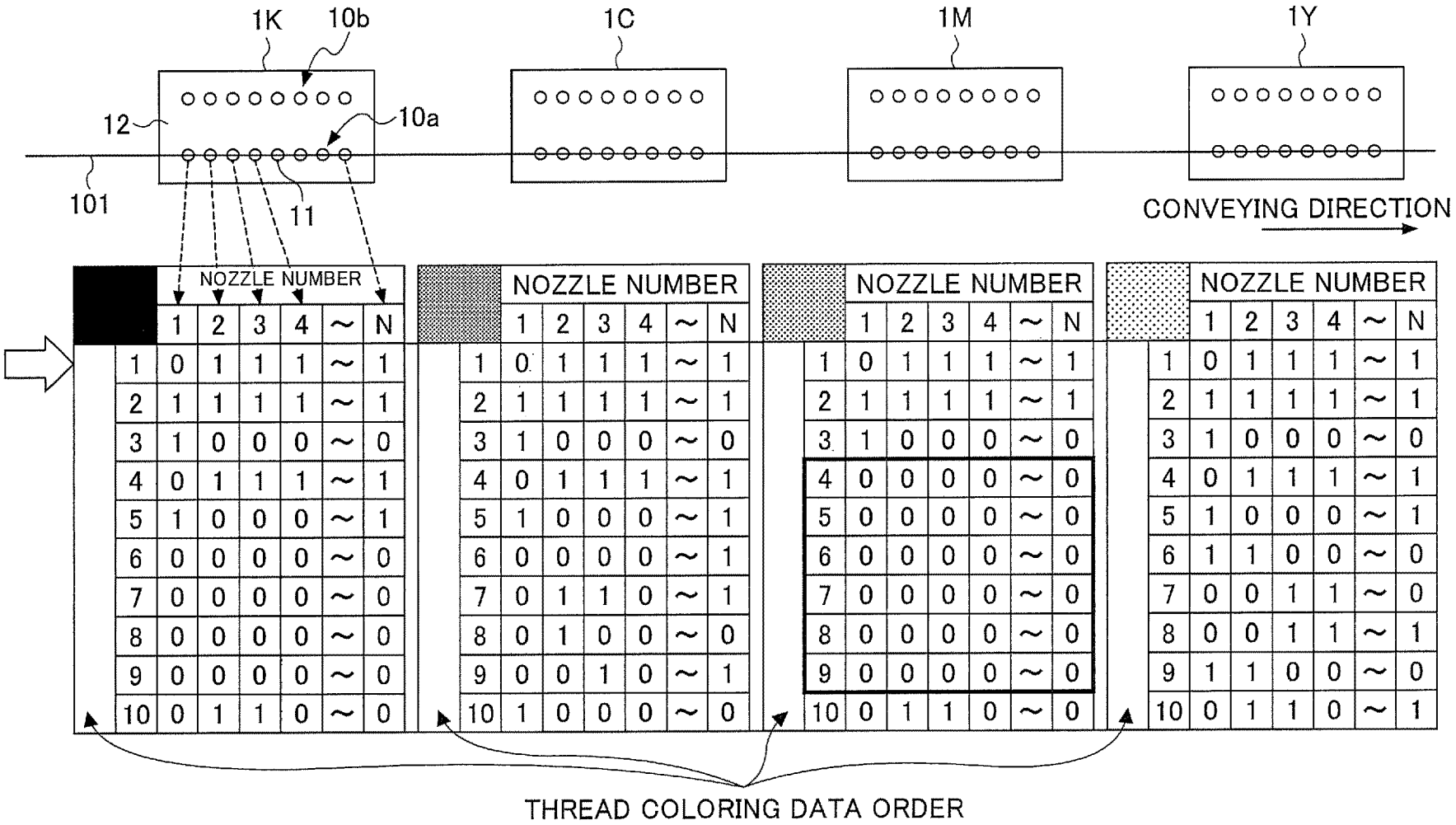
FIG. 13 illustrates an example of the head positions in the initial state and ejection/non-ejection information for each nozzle color in the thread coloring data according to the first embodiment of the present invention.

Example of Counting of Thread Coloring Data and Head Position According to the First Embodiment With reference to FIGS. 13 to 16, the relationship between the count value of the thread coloring data and the head position when executing the first control example will be described below. FIG. 13 is a diagram illustrating the head position in the initial state and ejection/non-ejection information for each nozzle of each color of the thread coloring data to which the first control example is applied.

In FIG. 13, a bottom view of the nozzle surface 12 of the head viewed from the bottom is illustrated at the top of FIG. 13. As illustrated in FIG. 13, the nozzle arrays 10*a* and 10*b* of each head are arranged in parallel with respect to the conveying direction of the thread 101. In each of the heads 1Y, 1M, 1C, and 1Y of each color, the nozzle array 10*a*, which is one of the two nozzle arrays of the nozzle array 10*a* and the nozzle arrays 10*b*, eject ink droplets to color the thread 101.

In FIG. 13, each of the tables illustrated at the bottom of FIG. 13 indicates ejection/non-ejection in the thread coloring data of each nozzle in the nozzle array. In this example, the threshold value for determining that idle ejection is possible is set to "6 ejection period (i.e., a period of six ejections, 6 count values)".

The "thread coloring data order" arranged vertically in the row in the lower table indicates the ejection order, that is, the ejection order with respect to the thread at a particular conveyance position, and the ink is ejected in the order of the thread coloring data order of 1→2→3→ . . . →10.

The numbers in "nozzle number" arranged horizontally in the "line" in the table correspond to the nozzle numbers in the nozzle array of each head. For example, in a nozzle array, the nozzle numbers are assigned as 1, 2, 3, . . . , N from one end in the order of the arrangement of nozzles.

In this table, "0" indicates "non-ejection" and "1" indicates "ejection" in the item where the thread coloring data order in the vertical row and the nozzle number in the horizontal line intersect each other.

For example, referring to the thread coloring data for the black head 1K, in the first ejection timing (the first ejection) in the thread coloring data, the second, third, fourth, . . . Nth nozzles are set as ejection, and the first nozzle is set as non-ejection.

Referring to the thread coloring data for the magenta head 1M, in a period from the fourth ejection to the ninth ejection in the thread coloring data, all nozzles in the nozzle array are set to non-ejection (0), and the period from the fourth ejection to the ninth ejection corresponds to greater than or equal to 6 ejections (6 counts) that is the threshold value. Therefore, it is determined that idle ejection is executable during the period from the fourth ejection to the ninth ejection.

When it is determined that idle ejection is executable, the head control unit 401 issues an idle ejection instruction to transmit, to the head position control unit 303, movement start information for head withdrawal and movement start information for head returning. Further, the head control unit 401 inputs, to the driving waveform generating unit 402, data in which non-ejection "0" is changed to "idle ejection" (ejection "1") at the ejection timing in substantially the middle of the non-ejection period in the coloring data (for example, in this case, the sixth ejection) together with the regular thread coloring data.

Figure 14:
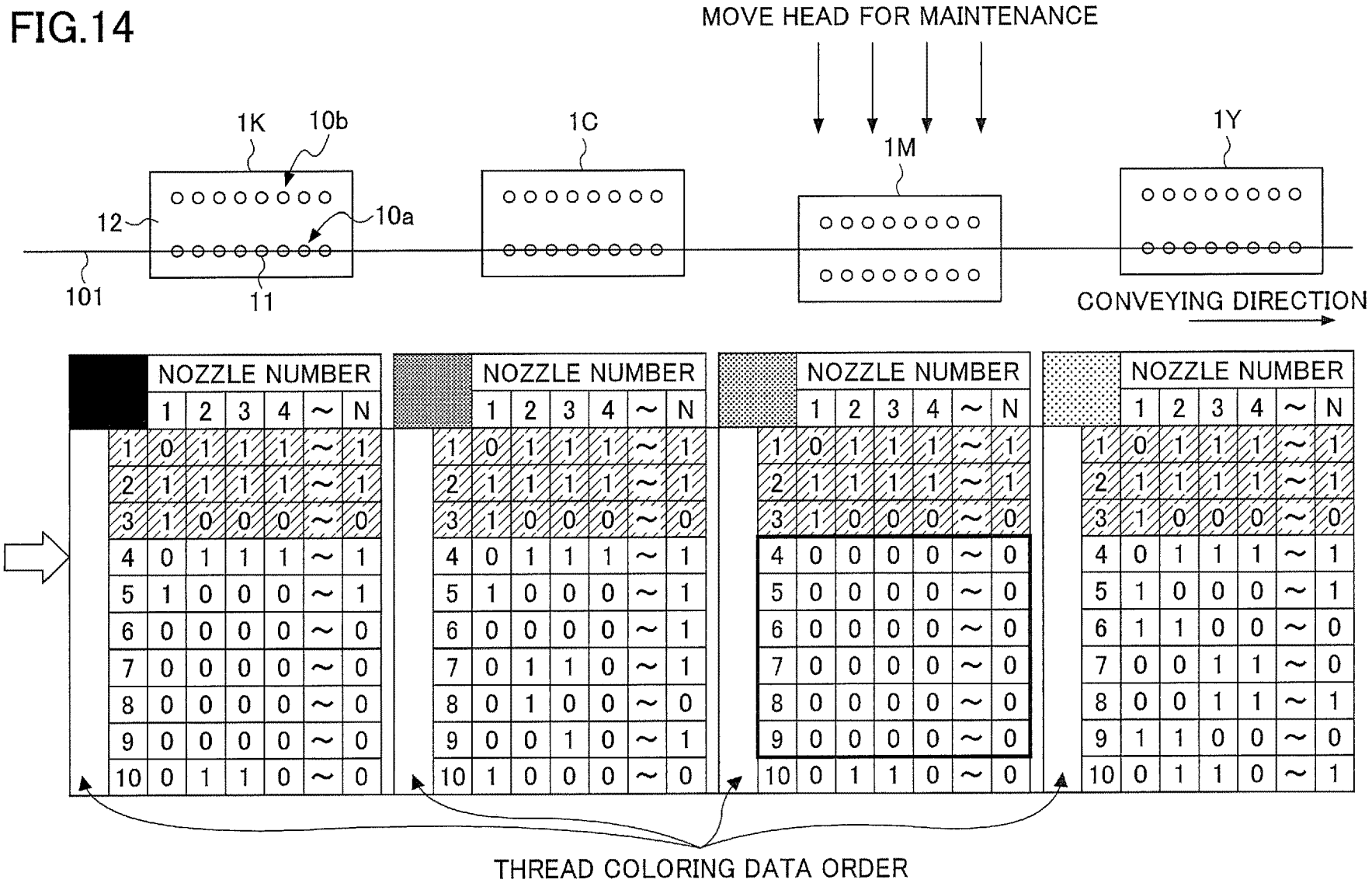
FIG. 14 is a diagram illustrating the head positions at the time of the fourth ejection in the thread coloring data, and ejection/non-ejection information for each nozzle color in the thread coloring data according to the first embodiment of the present invention.

FIG. 14 is a diagram illustrating head positions and ejection/non-ejection information for each nozzle of each color in the thread coloring data at the time of the fourth ejection in the thread coloring data to which the first control example is applied.

According to FIG. 13, it is determined that idle ejection can be executed during the period from the fourth ejection to the ninth ejection. Therefore, when it has been determined that idle ejection is necessary in advance, the idle ejection operation is executed during the period from the fourth ejection to the ninth ejection.

FIG. 14 illustrates the state of the fourth ejection. Therefore, the first ejection to the third ejection illustrated by the shaded portions in the table indicate the thread coloring data for which processing has been completed.

In the fourth ejection, the head 1M starts to move in an orthogonal direction to the conveying direction, and the nozzle array 10*a* that has been performing ejection is withdrawn from the position of scanning the thread 101, that is, the nozzle array 10*a* is withdrawn from the position where the nozzle array 10*a* faces the thread 101 where droplets would land of the thread if ejected from the nozzle array 10*a*.

At this time, while the head 1M is moved as described above, the other heads 1K, 1C, and 1Y are ejecting droplets from the nozzles corresponding to ejection "1" based on the thread coloring data of the fourth ejection, and are continuing the coloring operation with respect to the thread 101.

Figure 15:
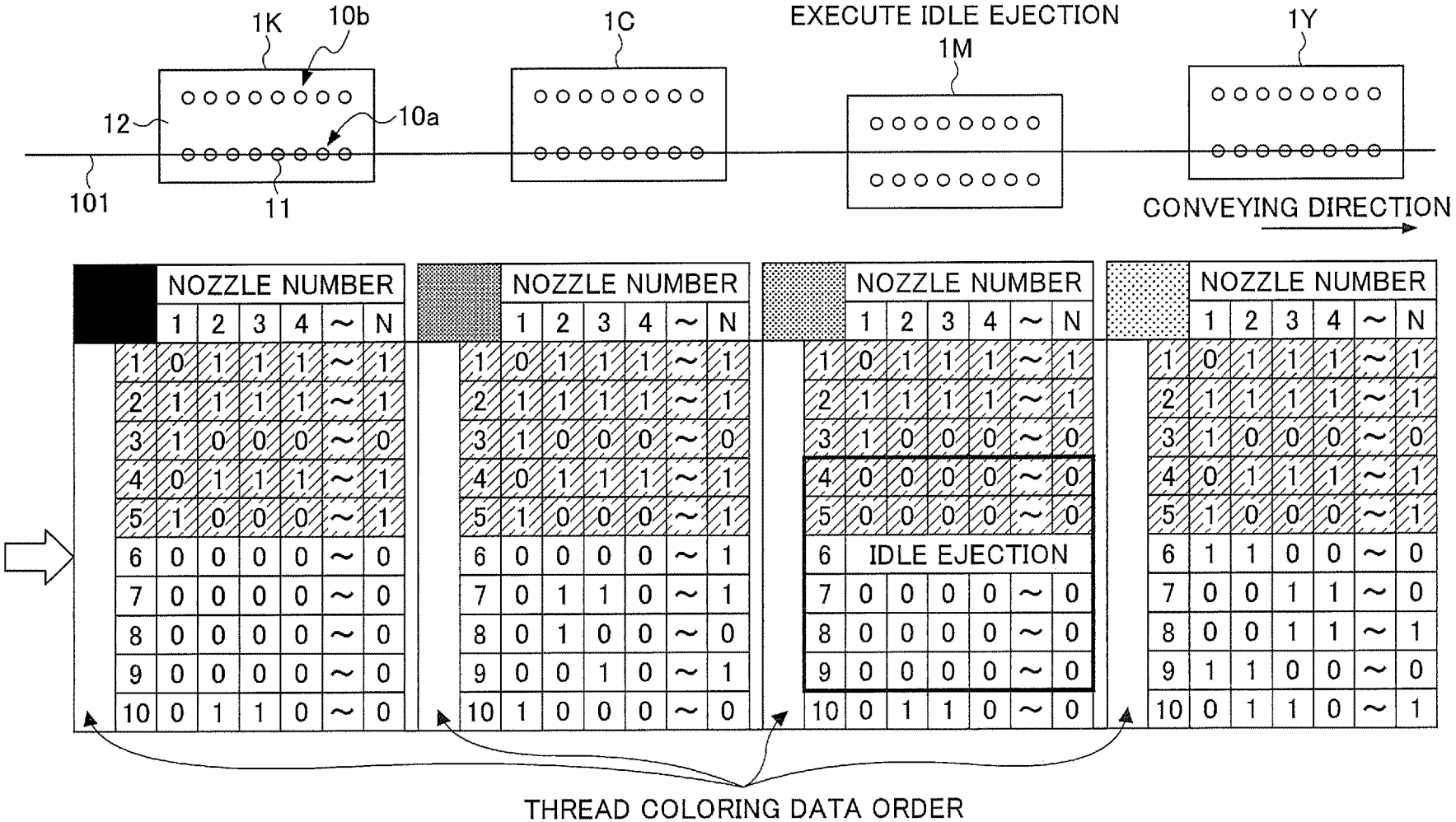
FIG. 15 is a diagram illustrating the head positions at the time of the sixth ejection in the thread coloring data, and ejection/non-ejection information for each nozzle color in the thread coloring data according to the first embodiment of the present invention.

FIG. 15 is a diagram illustrating head positions and ejection/non-ejection information for each nozzle of each color in the thread coloring data at the time of the sixth ejection in the thread coloring data to which the first control example is applied.

At the time of the sixth ejection in the thread coloring data, idle ejection is executed by the head 1M. The control in this example is a case where the ejection amount set in the idle ejection operation is 1, that is, a case where the droplet used for idle ejection is 1 droplet.

At this time, while the head 1M is executing idle ejection as described above, the other heads 1K, 1C, and 1Y are ejecting droplets from the nozzles corresponding to ejection "1" based on the thread coloring data of the sixth ejection, and are continuing the coloring operation with respect to the thread 101.

In the example of the present control, the after idle ejection elapsed time counting unit 517 of the head control unit 401 starts counting the elapsed time after idle ejection, from the seventh ejection that is immediately after the sixth ejection, which is the ejection timing at which idle ejection has been performed by the magenta head 1M.

Figure 16:
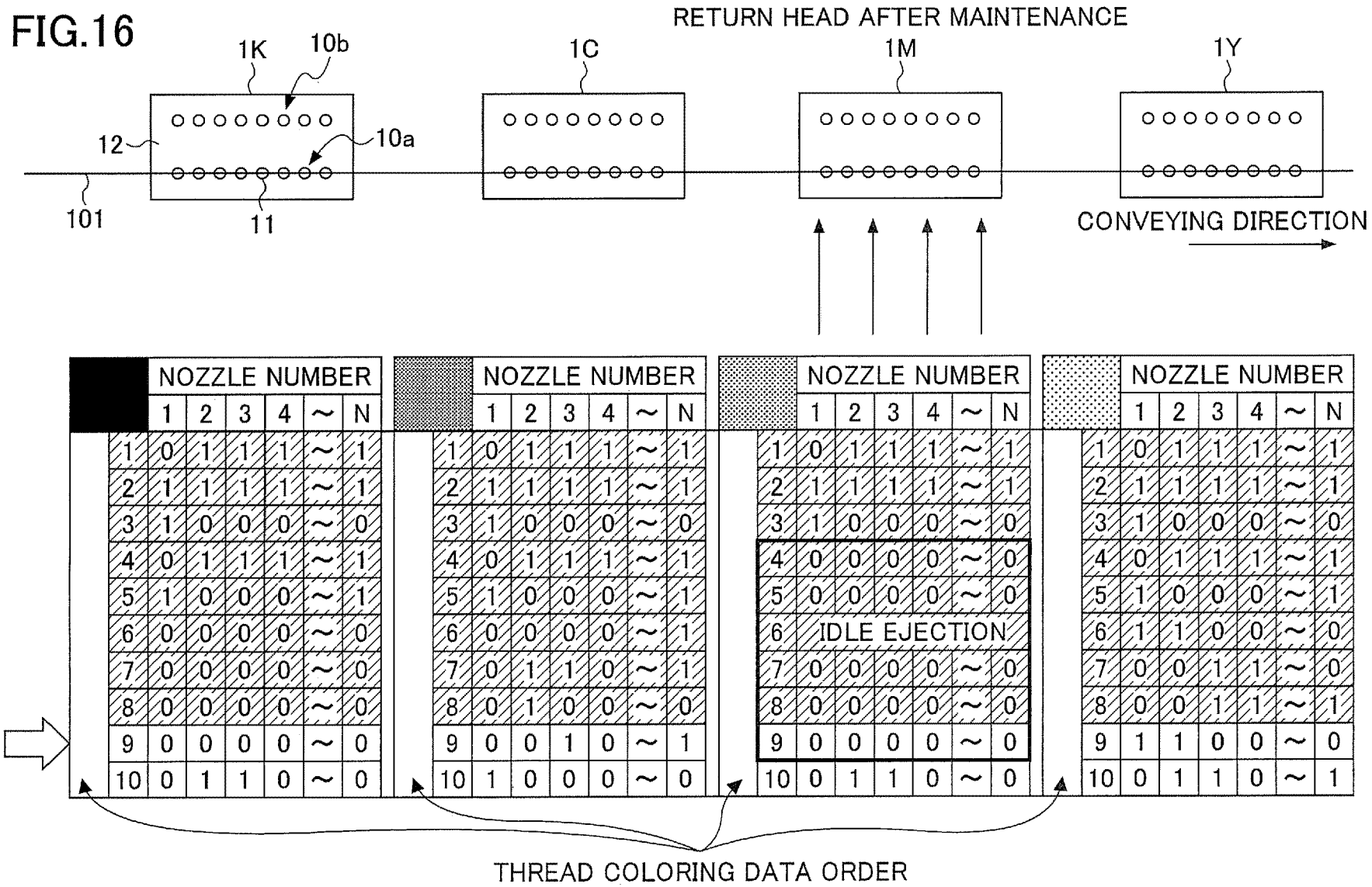
FIG. 16 is a diagram illustrating the head positions at the time of the ninth ejection in the thread coloring data, and ejection/non-ejection information for each nozzle color in the thread coloring data according to the first embodiment of the present invention.

FIG. 16 is a diagram illustrating head positions and ejection/non-ejection information for each nozzle of each color in the thread coloring data at the time of the ninth ejection in the thread coloring data to which the first control example is applied.

In the ninth ejection, the head 1M is moved in an orthogonal direction to the conveying direction, and the nozzle array 10*a* that has performed the idle ejection is returned to the position of scanning the thread 101, that is, the nozzle array 10*a* is returned to the position where the nozzle array 10*a* faces the thread 101 where droplets would land of the thread if ejected from the nozzle array 10*a*.

At this time, while the head 1M is moved to return to face the thread 101 as described above, the other heads 1K, 1C, and 1Y are ejecting droplets from the nozzles corresponding to ejection "1" based on the thread coloring data of the ninth ejection, and are continuing the coloring operation with respect to the thread 101.

As described above, by setting a threshold value for determining that idle ejection can be executed, which requires withdrawal, idle ejection, and returning, and detecting a non-ejection period of all nozzles that is greater than or equal to the threshold value in the thread coloring data, it is possible to perform the idle ejection operation with one ejection head during a period while another ejection head is performing the ejection operation for coloring. Accordingly, in the present invention, even in the liquid ejecting apparatus including a plurality of ejection heads, it is possible to perform idle ejection as a maintenance and recovery operation during an ejection operation without stopping the conveyance of the thread, and thus productivity can be improved.

Modified Example of Control

In this control operation, it is assumed that a plurality of nozzle arrays are provided in the ejection head. While performing a coloring operation from one nozzle array of the ejection head, when a blank period exists in the thread coloring data, another nozzle array is moved to face the thread, and this other nozzle array executes a coloring operation based on the subsequent thread coloring data. In this case, the other nozzle array is to undergo a maintenance operation immediately before being used or periodically.

In this control operation, the nozzle array for executing the ejection operation is changed before and after the maintenance operation. Accordingly, in the maintenance operation, only the movement for switching the nozzle arrays in the head is performed, and, therefore, the count value of the blank period to be the threshold value can be reduced. In this control operation, while another nozzle array is executing the coloring operation after the movement of switching the nozzle arrays, the nozzle array, which had been used for coloring until immediately before the switching movement, can perform an idle ejection operation.

Second Embodiment

In the above-described first embodiment, when performing an idle ejection operation, the head is moved to be withdrawn from the position facing the thread to eject the idle ejection droplets, but by bending the flying direction of the ejected droplets, the droplets may be caused to land in an idle ejection receiver without landing on the thread. A configuration example thereof will be described below as a second embodiment with reference to FIGS. 17 to 20.

Figure 17:
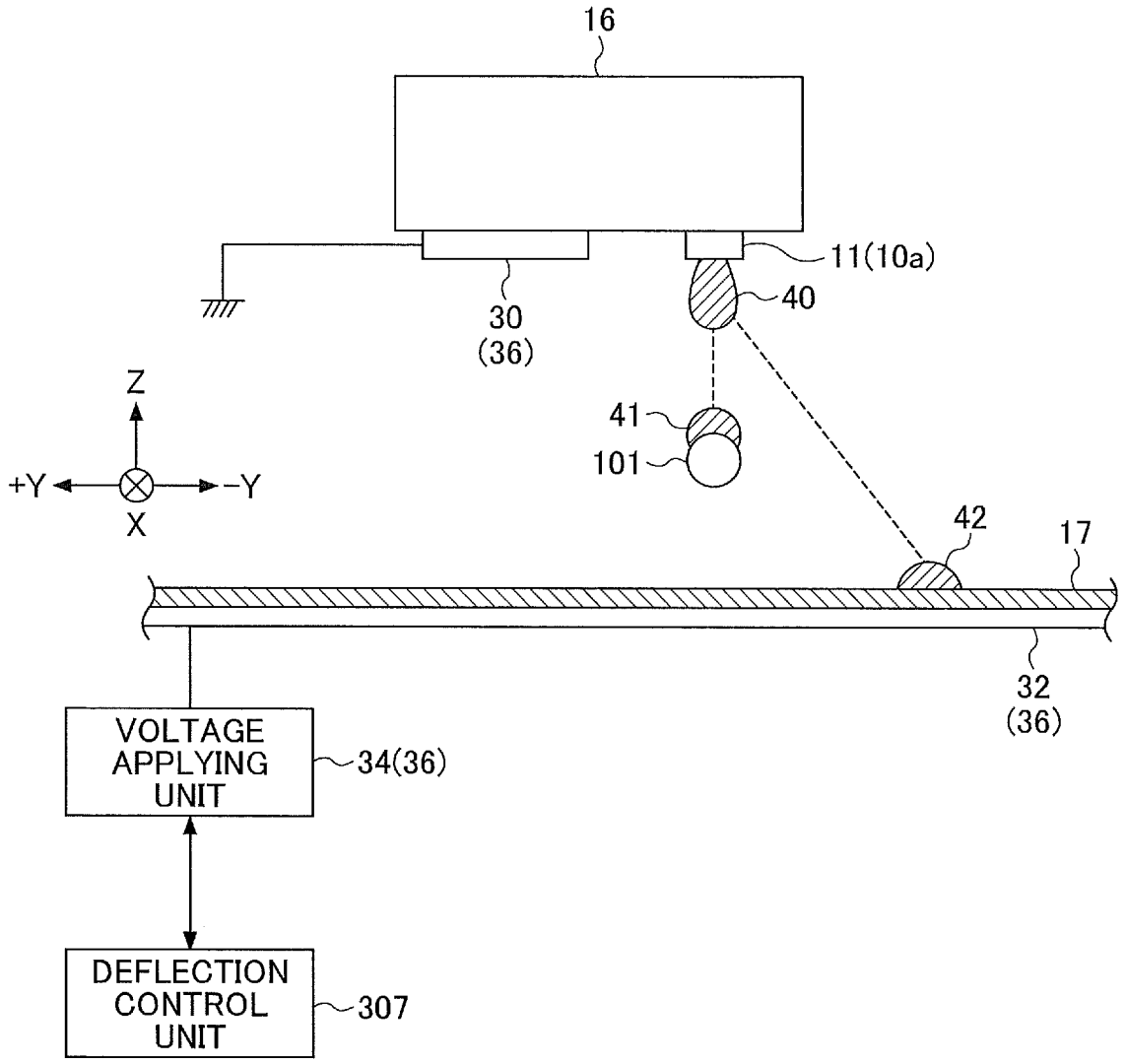
FIG. 17 is a diagram illustrating a schematic configuration of an idle ejection receiver and a deflecting unit according to a second embodiment of the present invention.

FIG. 17 is a diagram illustrating a schematic configuration of an ejection head, an idle ejection receiver, and a deflecting unit according to the second embodiment of the present invention.

In the present embodiment, a deflecting unit 36 is provided to bend (deflect) the flying direction of the droplets ejected from a nozzle. The deflecting unit 36 deflects the flying direction of the droplets ejected from the nozzle 11 in an orthogonal direction to the conveying direction of the thread 101 (±Y direction). The deflecting unit 36 includes, for example, a first electrode 30, a second electrode 32, and a voltage applying unit 34.

The first electrode 30 is connected to ground and a voltage is applied to the second electrode 32 from the voltage applying unit 34.

Specifically, the first electrode 30 is provided on the nozzle surface 12 adjacent to the nozzle array 10*a* including the nozzles 11, in an ejection head 16 according to the present embodiment. The first electrode 30 is disposed on the front side or the back side in the depth direction so as to be adjacent to the nozzle array 10*a* by a predetermined interval.

The first electrode 30 is a long plate-like member elongated along the arrangement direction of the nozzle array 10*a* (in FIG. 17, in a ±X direction). Thus, the first electrode 30 is disposed so as to be adjacent to all of the plurality of nozzles 11 of the nozzle array 10*a* provided in the ejection head 16, in an orthogonal direction to the arrangement direction on the nozzle surface 12 on the lower side of the ejection head 16.

In the example illustrated in FIG. 17, the first electrode 30 is disposed at the back side with respect to the nozzle array 10*a* (+Y side). The first electrode 30 may be disposed on the front side with respect to the nozzle array 10*a*, or may be disposed on both sides with respect to the nozzle array 10*a* in an orthogonal direction to the thread conveying direction which is the arrangement direction of the nozzle array 10*a*.

The second electrode 32 is disposed so as to face the nozzle surface 12 of the ejection head 16 via the thread 101. In the present embodiment, a mounting platform 17 is provided on the second electrode 32, and a part of the mounting platform 17 functions as an idle ejection receiver.

The voltage applying unit 34 is electrically connected to a deflection control unit 307 (see FIG. 18) and applies a voltage to the second electrode 32 according to control by the deflection control unit 307.

When a voltage is applied to the second electrode 32, a strong electric field is formed between the second electrode 32 and the first electrode 30 in accordance with a voltage value of the voltage applied to the second electrode 32. On the other hand, a droplet 40 ejected from the nozzle 11 is charged to have a predetermined polarity and an amount of charge in a state before flying from the nozzle 11. Therefore, the flight direction of the charged droplet 40 ejected from the nozzle 11 is deflected by the influence of the electric field.

In FIG. 17, in the present embodiment, the first electrode 30 is disposed on the back side with respect to the nozzle 11. Thus, an electric field is formed between the first electrode 30 and the second electrode 32, and, therefore, the flight direction of the droplet 40 ejected from the nozzle 11 is deflected in the back side or the front side in the ±Y direction that is the orthogonal direction to the conveying direction of the thread 101. Whether the direction of flight of the droplet 40 is deflected in the +Y direction or in the −Y direction is determined by the applied charge and whether a positive voltage or a negative voltage is applied before the flight of the droplet 40.

Here, when an electric field is not formed between the first electrode 30 and the second electrode 32, and the droplet 40 is ejected from the nozzle 11, the ejected droplet 40 falls directly below by a force of gravity. As this droplet falling directly below adheres to the thread 101, which is extending so as to face the nozzle array 10*a*, a dot 41 adheres onto the thread 101 and the components of the dot 41 permeate the thread, so that the thread 101 becomes colored (dyed).

On the other hand, when an electric field is formed between the first electrode 30 and the second electrode 32, and the droplet 40 is ejected from the nozzle 11, the falling direction (the flying direction) of the ejected droplet 40 is deflected from a direction extending directly below, to the −Y direction, so that a dot 42 lands on the mounting platform 17. In the present embodiment, by generating an electric field, the flight direction of the droplet 40 is deflected in an orthogonal direction to the thread conveying direction, and the droplet 40 is displaced from the thread 101 so that the ejected droplet lands on the mounting platform 17 which is an idle ejection receiver, and this is referred to as the idled ejection operation.

Note that the deflecting unit 36 illustrated in FIG. 17 has been described to have a configuration in which the flight direction of the droplet 40 is deflected by generating an electric field, and the landing position of the droplet 40 is displaced from the thread 101 to land on the mounting platform 17 (the idle ejection receiver). However, as long as the flight direction of the droplet can be deflected, the method of deflecting the droplet is not limited.

For example, the deflecting unit 36 may be configured to deflect the droplet 40 by using a magnetic field, wind power, sound waves, and the like. For example, a plurality of heaters such as heating members may be provided directly under the nozzles 11, and the deflection direction or the deflection amount may be adjusted by adjusting the heater members to be energized.

Figure 18:
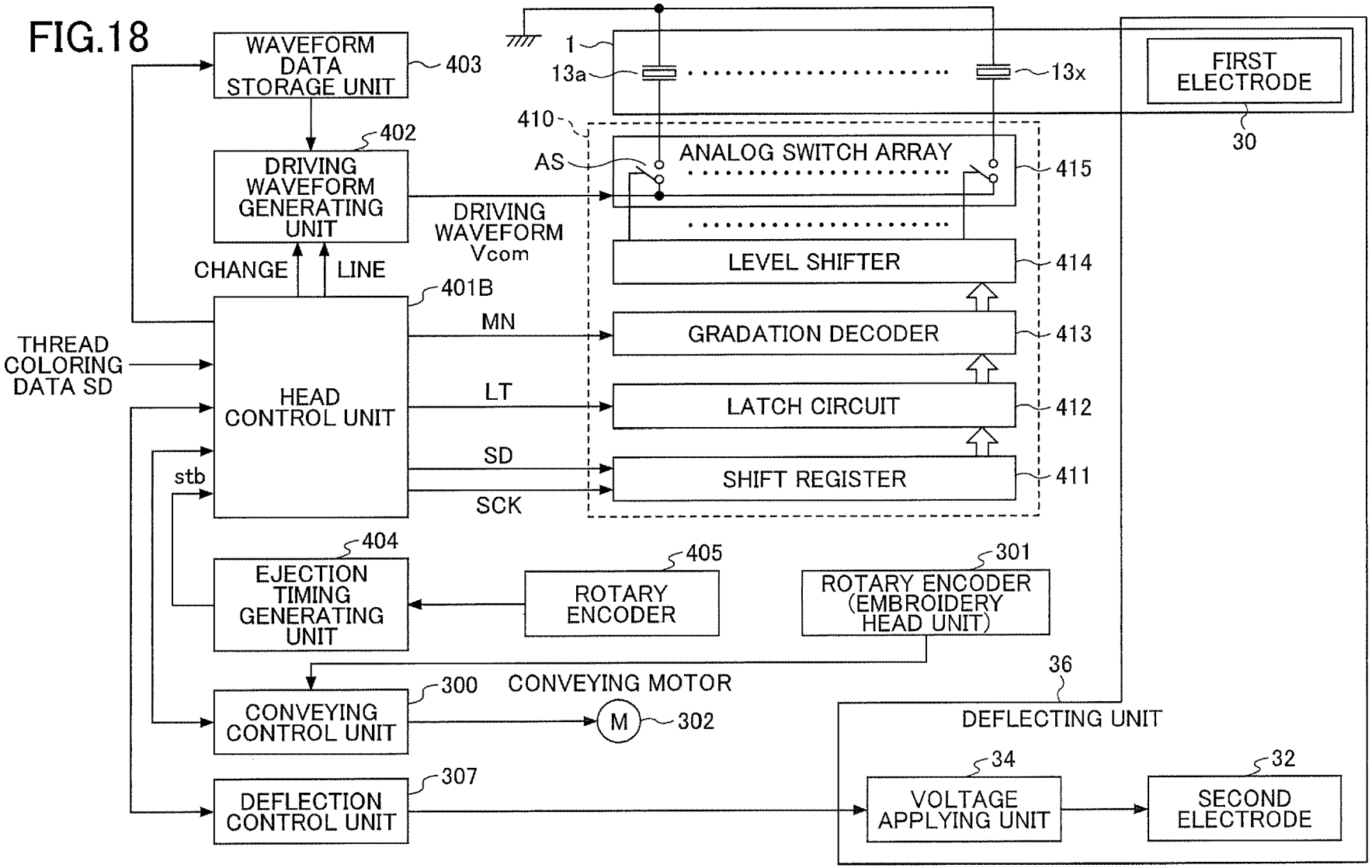
FIG. 18 is a control block diagram of the part related to droplet ejection and idle ejection control in the liquid ejecting apparatus according to the second embodiment of the present invention.

FIG. 18 is a control block diagram illustrating the portion related to liquid ejection and idle ejection control in the liquid ejecting apparatus according to the second embodiment of the present invention. Only the differences from the first embodiment will be described.

In the control configuration according to the present embodiment, instead of the head position control unit and the cap raising/lowering control unit, the deflection control unit 307 is provided.

The deflection control unit 307 applies a voltage to the second electrode 32 of the deflecting unit 36 when an instruction for idle ejection execution is issued from a head control unit 401B. When an electric field is formed between the first electrode 30 and the second electrode 32, the head control unit 401B controls the ejection of droplets for a predetermined number of droplets or for a predetermined period of time, so that droplets for idle ejection for which the flight path is changed, land on the mounting platform 17 that is an idle ejection receiver. When the idle ejection is completed, the deflection control unit 307 stops applying a voltage to the second electrode 32.

The deflection control unit 307 sends, to the head control unit 401B, feedback indicating that the application of an electric field to the second electrode 32 has stopped, and then the head control unit 401B resumes the ejection operation for coloring the thread 101.

Figure 19:
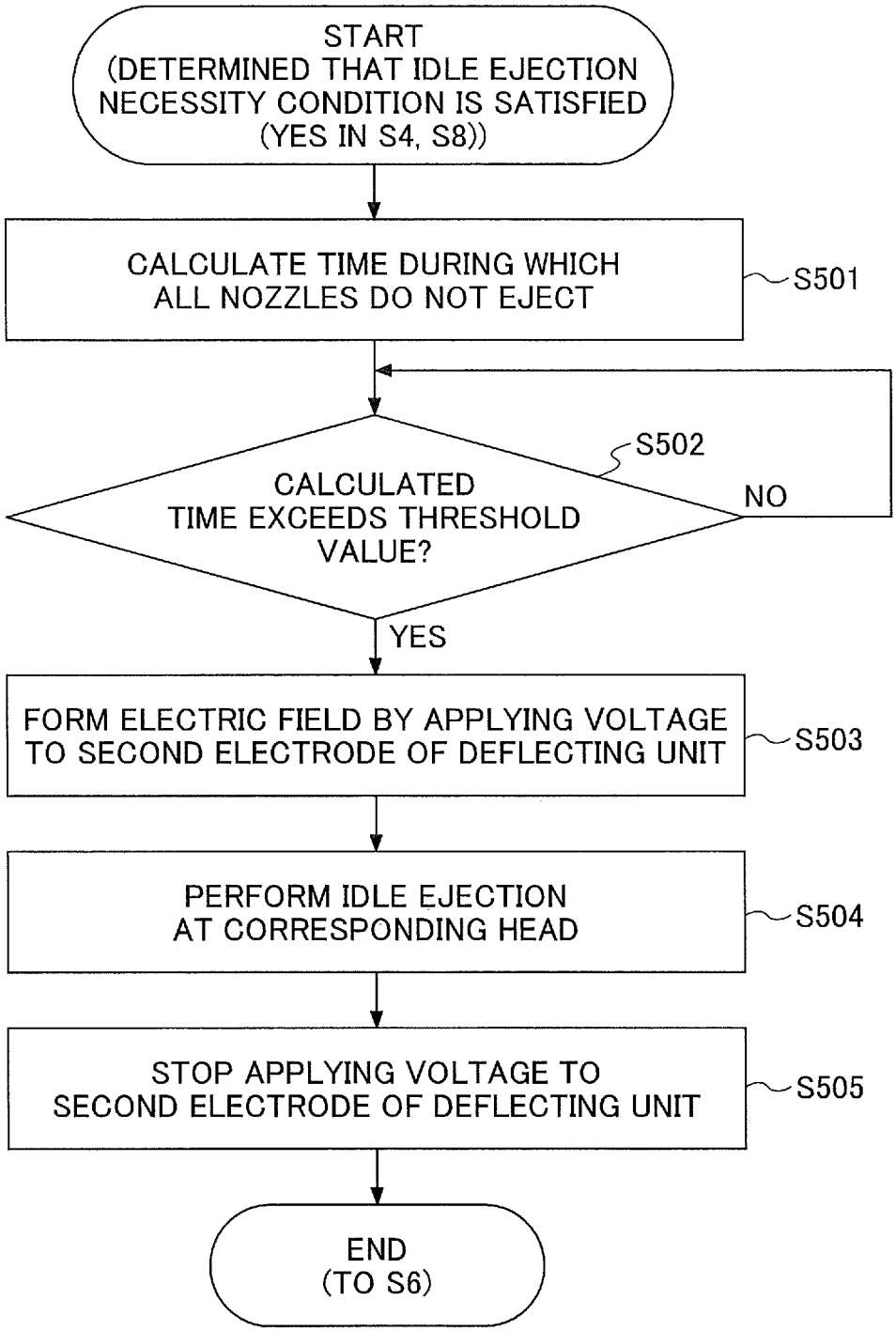
FIG. 19 is a detailed flowchart of an idle ejection execution operation according to the second embodiment of the present invention.

FIG. 19 is a detailed flowchart of an idle ejection execution operation according to the second embodiment of the present invention. Differences from the first embodiment will be described.

In step S502, when there is a portion where the non-ejection period exceeds the first threshold value (threshold time) in the thread coloring data, the process proceeds to step S503. In the present embodiment, the first threshold value that is used to determine that the idle ejection is executable, is set to a time required for generating an electric field, performing idle ejection, and stopping the electric field.

In step S503, an electric field is formed between the first electrode and the second electrode by applying a voltage to the second electrode in the deflecting unit. In this state, in step S504, droplets are ejected by a corresponding head. By ejecting droplets in a state where the electric field is generated, the flying droplets are deflected, so that the droplets land on the idle ejection receiver (the mounting platform 17), and not on the thread, resulting in idle ejection.

After the predetermined idle ejection is completed, in step S505, the application of the voltage electric field by the second electrode 32 of the deflecting unit is ended.

According to the present embodiment, an idle ejection operation is performed upon detecting a non-ejection period of a predetermined period in the thread coloring data, and, therefore, the liquid ejecting apparatus can perform the idle ejection as the maintenance and recovery operation during the ejection operation without stopping the conveyance, and thus the productivity can be improved.

Further, in the configuration in which the head is moved as in the first embodiment, position detection control for confirming the completion of the movement of the head is required in order to improve the accuracy of the stop position of the head. However, in the present embodiment, there is no head movement, and only the application of a voltage in the deflecting unit is required to adjust the landing position of the droplet, and it is therefore advantageous in terms of position accuracy. Further, it is not necessary to move the head, which takes time, and, therefore, it is possible to reduce the time of the first threshold used for determining that idle ejection is executable, although an additional mechanism for generating an electric field is required.

Therefore, with respect to the configuration of performing the idle ejection operation according to an embodiment of the present invention, it is preferable to select either the first embodiment or the second embodiment as appropriate, according to the application, the configuration, the size of the apparatus, and the like.

Modified Example of Second Embodiment

Figure 20:
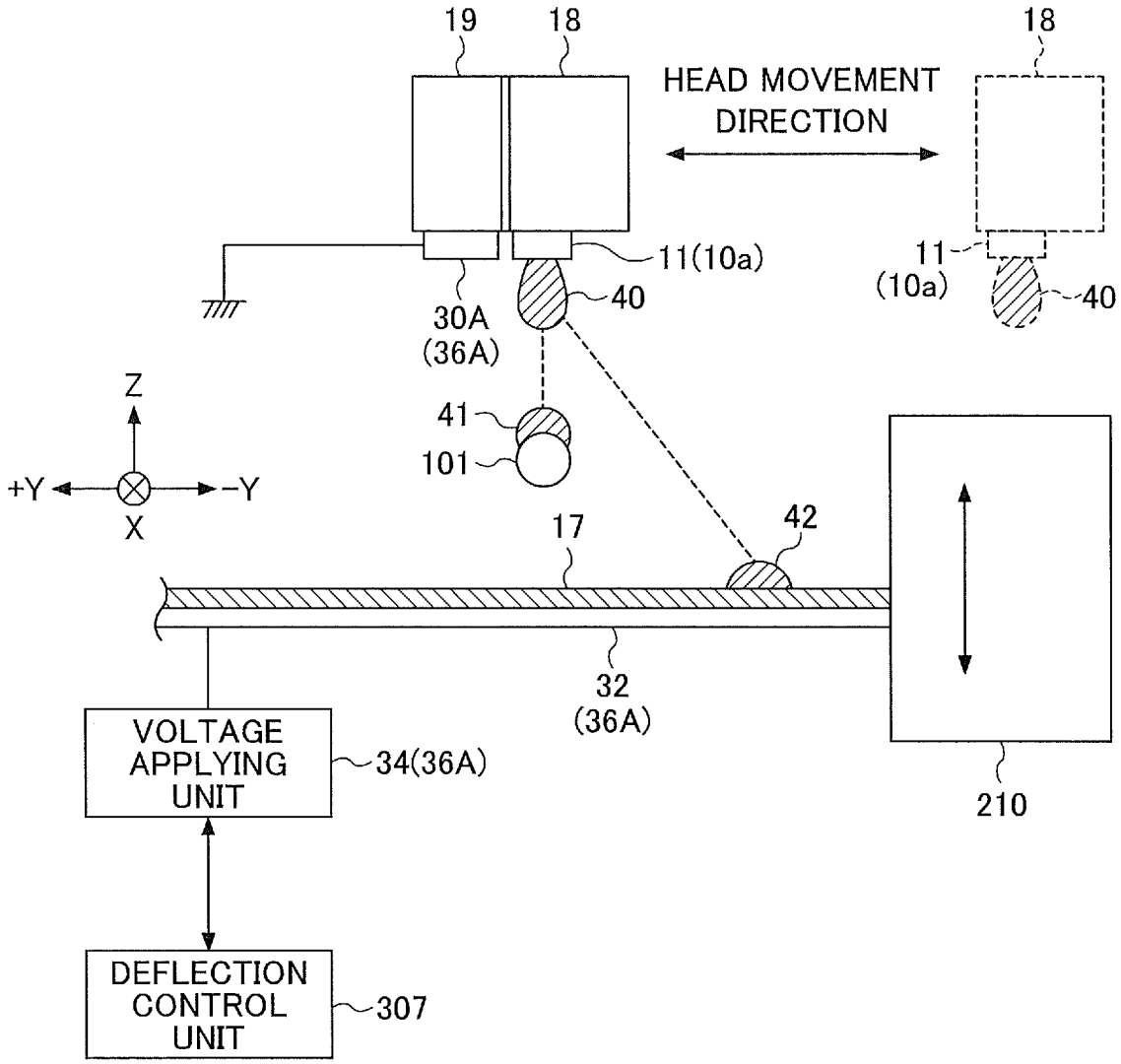
FIG. 20 illustrates a schematic configuration of an idle ejection receiver, the deflecting unit, and a cap according to a modified example of the second embodiment of the present invention.

FIG. 20 illustrates a modified example of the second embodiment.

In the example described above, the first electrode 30 is provided integrally with the ejection head 16, but the first electrode may be provided separately from the ejection head in which the nozzle array is provided.

In this configuration, at the upper side, the nozzle array 10*a* including the plurality of nozzles 11, and a first electrode 30A, are supported by separate heads. Specifically, the nozzle array 10*a* in which the plurality of nozzles 11 are arranged side by side, is formed in a head 18 (ejection head), and the first electrode 30A extending substantially parallel to the nozzle array 10*a*, is provided in an electrode head 19. On the lower side, a cap 210 that can be raised and lowered, is provided next to the mounting platform 17 that is an idle ejection receiver.

The head 18 including the nozzle array 10*a* is movable between a position directly above the thread 101 and a position above the cap 210. When the head 18 is situated directly above the thread 101, the head 18 is positioned near the first electrode 30A, and, therefore, the head 18 is affected by the first electrode 30A and the second electrode 32, which form a deflecting unit 36A. However, when the head 18 is positioned above the cap 210, the head 18 is hardly affected by the first electrode 30A or the second electrode 32.

Accordingly, in a state where the head 18 is positioned close to the first electrode 30A as illustrated by solid lines in FIG. 20, the head 18 executes ejection with respect to the thread 101 or idle ejection to the mounting platform 17. In a state where the head 18 is above the cap 210 as illustrated by dotted lines in FIG. 20, capping is performed with respect to the head 18 by raising the cap 210.

<Another Liquid Ejecting Apparatus>

Figure 21:
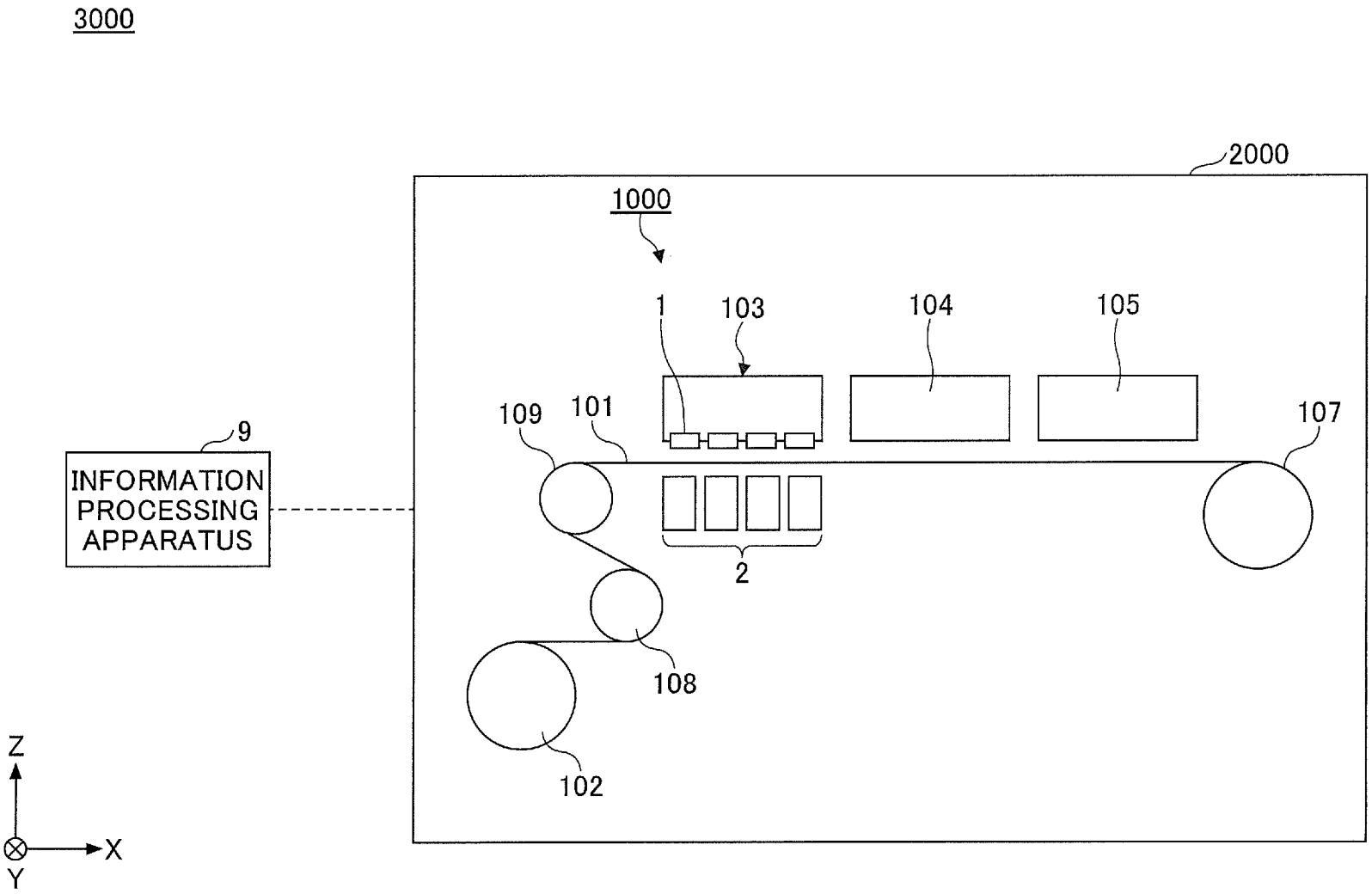
FIG. 21 is an exemplary schematic diagram of a coloring system according to another embodiment of the present invention.

Next, an example of a liquid ejecting apparatus according to another embodiment of the present invention will be described with reference to FIG. 21. FIG. 21 is an example of a schematic diagram of a coloring system in which a liquid ejecting apparatus according to another embodiment of the present invention is mounted.

In a liquid ejecting apparatus 2000, the embroidery head 106 of the coloring/embroidery apparatus 1000 illustrated in FIG. 1 is replaced with a take-up reel 107 for winding the thread 101 that has been colored.

The liquid ejecting apparatus 2000 supplies the thread 101 from the supply reel 102, ejects the liquid of the desired color from the liquid applying unit 103 and applies the liquid to the thread 101, dyes the thread 101 with the desired color, and winds the dyed thread 101 onto the take-up reel 107.

Also in the present liquid ejecting apparatus 2000, by the method according to the first embodiment, when the period required for movement and idle ejection is counted as a threshold value, and there is a portion of a corresponding period in the coloring data, a maintenance and recovery operation can be performed in which the head is moved to be withdrawn to perform idle ejection, and then the head is moved to be returned. Accordingly, it is possible to perform idle ejection as a maintenance and recovery operation during the ejection operation without stopping the conveyance, and thus the productivity can be improved.

Alternatively, in the present configuration, according to the method according to the second embodiment, when the period required for voltage application and idle ejection for each head is counted as a threshold value, and there is a portion of a corresponding period in the coloring data, a maintenance and recovery operation can be performed in which an electric field is formed by applying a voltage to the electrode, idle ejection is performed by bending the flight path of a droplet so that the droplet is directed toward the idle ejection receiver, and then the formation of the electric field is stopped. Accordingly, it is possible to perform idle ejection as a maintenance and recovery operation during the ejection operation without stopping the conveyance, and thus the productivity can be improved.

Further, the information processing apparatus 9, as a client PC (higher-level device), may be connected to the liquid ejecting apparatus 2000. The liquid ejecting apparatus 2000 and the information processing apparatus 9 are combined to form a coloring system (liquid ejecting system) 3000.

When the information processing apparatus 9 that is the client PC is connected, the process for determining whether the idle ejection necessity condition is satisfied and the process for determining whether execution of the idle ejection is possible, which are processes performed by the head control unit 401 in the above-described embodiment, may be performed by the information processing apparatus 9.

In the above-described embodiment, when all nozzles of each head are detected as being in a non-ejection state for greater than or equal to a threshold value (for example, 6 dots) in the data received by the head control unit 401, an instruction is given for head movement, idle ejection, and head returning. However, according to the present embodiment, the head control unit receives data from the client PC (the information processing apparatus 9), and, therefore, at the time of a Raster Image Processor (RIP) process by the information processing apparatus 9, the information processing apparatus 9 detects non-ejection of 6 dots or more for all nozzles, and transmits information regarding the start of head movement together with the thread coloring data, information regarding the change from 0 data (non-ejection) to "idle ejection" in the coloring data, and information regarding the start of the returning movement of the head. Then, the head control unit of the liquid ejecting apparatus 2000 executes an operation based on the transmitted information.

In the information processing apparatus 9, the number of non-ejection dots (time) is calculated (counted) from the thread coloring data by rendering. In this case, the information processing apparatus 9 includes thread coloring data, and, therefore, batch processing is possible, so that an exclusive-use hardware function is not necessary.

The present invention is not limited to the liquid ejecting apparatus having the take-up reel as illustrated in FIG. 21. As illustrated in FIG. 1, the coloring/embroidery apparatus 1000 having the embroidery head 106 at the later stage may also be connected to the information processing apparatus 9 as the client PC (the higher-level device), and the functions of the idle ejection necessity determining unit and the idle ejection execution possibility determining unit, that are performed by the head control unit, may be performed by the client PC.

Although preferred embodiments and examples of the present invention have been described, the present invention is not limited to the embodiments and examples described above. The present invention may also be varied or modified in the light of the appended claims.

According to one embodiment of the present invention, a liquid ejecting apparatus for ejecting liquid to an ejection target medium, that enables idle ejection, which is a maintenance/recovery operation, without stopping the conveyance during the ejection operation, is provided, thereby improving productivity.

The liquid ejecting apparatus, the embroidery system, and the method for controlling the liquid ejecting apparatus are not limited to the specific embodiments described in the detailed description, and variations and modifications may be made without departing from the spirit and scope of the present invention.

What is claimed is:

1. A liquid ejecting apparatus comprising:

a plurality of ejection heads, each ejection head of the plurality of ejection heads including a nozzle array in which a plurality of nozzles are arranged in an array, and being configured to execute a coloring operation by ejecting a droplet onto an ejection target medium that is conveyed in the liquid ejecting apparatus;

an ejection receiver configured to receive the droplet ejected by an ejection head of the plurality of ejection heads, the ejection receiver having a width greater than a width of the conveyed ejection target medium;

a processor; and a memory storing program instructions, wherein for each ejection head, a nozzle array arrangement direction in which the plurality of nozzles are arranged in the array, runs parallel with a conveying direction in which the ejection target medium is conveyed, and the program instructions cause the processor to:

control a first ejection head from among the plurality of ejection heads to move at a predetermined timing to a position facing the ejection target medium; and eject the droplet toward the ejection target medium, and determine whether execution of an idle ejection operation is possible by calculating a time during which all of the plurality of nozzles in the nozzle array, in each of the plurality of ejection heads, do not perform ejection of the respective droplets based on coloring data; and comparing the time during which all of the plurality of nozzles do not perform ejection of the respective droplets with a time required to perform the idle ejection operation, which includes ejection of the respective droplets to the ejection receiver, and control a second ejection head from among the plurality of ejection heads, other than the first ejection head, that is executing the coloring operation to withdraw from the position facing the ejection target medium simultaneously with the moving of the first ejection head, and control the nozzle array in the second ejection head to perform the idle ejection operation, without stopping the ejection target medium, upon determining that the time during which all of the plurality of nozzles do not perform ejection is longer than or equal to the time required to perform the idle ejection operation.

2. The liquid ejecting apparatus according to claim 1, further comprising:

a conveying mechanism configured to convey the ejection target medium in a direction parallel with the nozzle array arrangement direction.

3. The liquid ejecting apparatus according to claim 2, further comprising:

a head mover configured to move each of the plurality of ejection heads in an orthogonal direction that is orthogonal to the conveying direction of the ejection target medium, wherein the idle ejection operation includes withdrawing the nozzle array of the corresponding ejection head that is executing the coloring operation from the position facing the ejection target medium, ejecting, to the ejection receiver, an idle droplet from the nozzle array of the corresponding ejection head that has been withdrawn, and returning the nozzle array of the corresponding ejection head to the position facing the ejection target medium, and wherein the threshold time is set to be a time required for performing the withdrawal of the nozzle array, the ejecting of the idle droplet, and the returning of the nozzle array.

4. The liquid ejecting apparatus according to claim 2, further comprising:

a first electrode provided on a nozzle surface, on which the nozzle array is formed, of each ejection head of the plurality of ejection heads, the first electrode extending in the nozzle array arrangement direction and being disposed adjacent to the nozzle array in a direction orthogonal to the nozzle array arrangement direction; and a second electrode provided on a surface facing at least a part of the nozzle surface of each of the plurality of ejection heads with the ejection target medium situated between the first electrode and the second electrode, the second electrode being configured to form an electric field between the first electrode and the second electrode, and wherein the idle ejection operation includes generating the electric field between the first electrode and the second electrode, deflecting an idle droplet ejected from the nozzle array of the corresponding ejection head while the idle droplet is flying so that the idle droplet lands on the ejection receiver, in a state in which the electric field is generated, and stopping the generating of the electric field, and wherein the threshold time is set to be a time required for performing the generation of the electric field, the deflection of the idle droplet, and the stopping of the generation of the electric Geld.

5. The liquid ejecting apparatus according to claim 1, wherein during a period in which one ejection head among the plurality of ejection heads is continuously performing an ejection operation of ejecting the droplet to the ejection target medium to color the ejection target medium, another ejection head among the plurality of ejection heads performs an idle ejection operation including ejection of the droplet to the ejection receiver.

6. The liquid ejecting apparatus according to claim 1, wherein the program instructions further cause the processor to:

determine whether an idle ejection operation including ejection of the droplet to the ejection receiver is necessary for each of the plurality of nozzles in the nozzle array in each of the plurality of ejection heads, by calculating a time during which all of the plurality of nozzles in the nozzle array in each of the plurality of ejection heads do not perform ejection of the droplet based on coloring data, and counting a time during which ejection of the droplet is not performed in the coloring data, upon determining that the idle ejection operation is necessary.

7. The liquid ejecting apparatus according to claim 6, wherein the program instructions further cause the processor to:

count a period during which ejection of the droplet is not performed by each of the plurality of nozzles in the nozzle array based on the coloring data, and determine that the idle ejection operation is necessary in a case where the nozzle array including one or more nozzles for which the period during which ejection of the droplet is not performed exceeds a threshold time by a predetermined time or more, wherein the threshold time is a time required to perform the idle ejection operation including ejection of the droplet to the ejection receiver.

8. The liquid ejecting apparatus according to claim 6, wherein the program instructions further cause the processor to:

count an elapsed time from an instruction to start a coloring ejection operation by ejecting the droplet to the ejection target medium or from a previous idle ejection operation, and determine that the idle ejection operation is necessary for the nozzle array continuing the coloring ejection operation, in a case where the elapsed time exceeds a threshold time by a predetermined time or more, wherein the threshold time is a time required for performing the idle ejection operation including ejection of the droplet to the ejection receiver.

9. The liquid ejecting apparatus according to claim 7, wherein the predetermined time is variable according to at least one of factors including a type of the droplet, a temperature, and an operation mode.

10. The liquid ejecting apparatus according to claim 1, wherein the program instructions further cause the processor to:

calculate a time during which all of the plurality of nozzles in the nozzle array in each of the plurality of ejection heads do not perform ejection of the droplet based on coloring data, and wherein the time during which the nozzle array of each of the plurality of ejection heads does not perform ejection is counted by a field-programmable gate array (FPGA).

11. An embroidery system comprising:

a liquid ejecting apparatus; and an embroidery apparatus to which an ejection target medium is conveyed from the liquid ejecting apparatus, wherein the liquid ejecting apparatus includes:

a plurality of ejection heads, each ejection head of the plurality of ejection heads including a nozzle array in which a plurality of nozzles are arranged in an array, and being configured to execute a coloring operation by ejecting a droplet onto an ejection target medium that is conveyed in the liquid ejecting apparatus;

an ejection receiver configured to receive the droplet ejected by an ejection head of the plurality of ejection heads, the ejection receiver having a width greater than a width of the conveyed ejection target medium;

a processor; and a memory storing program instructions, wherein for each ejection head, a nozzle array arrangement direction in which the plurality of nozzles are arranged in the array, runs parallel with a conveying direction in which the ejection target medium is conveyed, and the program instructions cause the processor to:

control a first ejection head from among the plurality of ejection heads to move at a predetermined timing to a position facing the ejection target medium; and eject the droplet toward the ejection target medium, and determine whether execution of an idle ejection operation is possible by calculating a time during which all of the plurality of nozzles in the nozzle array, in each of the plurality of ejection heads, do not perform ejection of the respective droplets based on coloring data; and comparing the time during which all of the plurality of nozzles do not perform ejection of the respective droplets with a time required to perform the idle ejection operation that includes ejection of the respective droplets to the ejection receiver, and control a second ejection head from among the plurality of ejection heads, other than the first ejection head, to withdraw from the position facing the ejection target medium simultaneously with the moving of the first ejection head, and controls the nozzle array in the second ejection head to perform the idle ejection operation, without stopping the ejection target medium, upon determining that the time during which all of the plurality of nozzles do not perform ejection is longer than or equal to the time required to perform the idle ejection operation.

12. A method for controlling a liquid ejecting apparatus that includes:

an ejection head including a nozzle array in which a plurality of nozzles are arranged in an array, the plurality of nozzles being configured to execute a coloring operation by ejecting a droplet onto an ejection target medium that is conveyed in the liquid ejecting apparatus;

a conveying mechanism configured to convey an ejection target medium in a direction parallel with a nozzle array arrangement direction in which the plurality of nozzles of the nozzle array are arranged; and an ejection receiver configured to receive an idle droplet ejected from the plurality of nozzles, wherein the ejection receiver has a width greater than a width of the conveyed ejection target medium, and the idle droplet does not color the ejection target medium, the method comprising:

calculating a time during which all of the plurality of nozzles in the nozzle array in the ejection head do not perform ejection of the droplet based on coloring data;

comparing the time during which all of the plurality of nozzles do not perform ejection of the droplet with a time required to perform an idle ejection operation that includes ejection of the idle droplet to the ejection receiver; and causing the nozzle array in the ejection head that is executing the coloring operation to instead perform the idle ejection operation without stopping the ejection target medium, upon determining that the time during which all of the plurality of nozzles do not perform ejection is longer than or equal to the time required to perform the idle ejection operation.

* * * * *